US010576731B2

(12) United States Patent
Ito et al.

(10) Patent No.: US 10,576,731 B2
(45) Date of Patent: Mar. 3, 2020

(54) SCREEN PRINTING PLATE, PRINTING DEVICE, AND METHOD FOR MANUFACTURE OF A SUBSTRATE HAVING A CURVED SURFACE

(71) Applicant: AGC Inc., Chiyoda-ku (JP)

(72) Inventors: Jun Ito, Tokyo (JP); Hidenobu Watanabe, Tokyo (JP); Nobuyuki Tanaka, Tokyo (JP)

(73) Assignee: AGC Inc., Chiyoda-ku (JP)

( * ) Notice: Subject to any disclaimer, the term of this patent is extended or adjusted under 35 U.S.C. 154(b) by 0 days.

(21) Appl. No.: 15/978,638

(22) Filed: May 14, 2018

(65) Prior Publication Data

US 2018/0264799 A1 Sep. 20, 2018

Related U.S. Application Data

(63) Continuation of application No. PCT/JP2016/082221, filed on Oct. 31, 2016.

(30) Foreign Application Priority Data

Nov. 18, 2015 (JP) ..... 2015-226120
Aug. 8, 2016 (JP) ..... 2016-155999

(51) Int. Cl.
*B41F 15/08* (2006.01)
*B41F 15/38* (2006.01)
(Continued)

(52) U.S. Cl.
CPC ..... *B41F 15/08* (2013.01); *B41F 15/0895* (2013.01); *B41F 15/30* (2013.01);
(Continued)

(58) Field of Classification Search
CPC ..... B41F 15/08; B41F 15/0895; B41F 15/30; B41F 15/38; B41F 15/42; B41F 15/423;
(Continued)

(56) References Cited

U.S. PATENT DOCUMENTS 2,105,378 A * 1/1938 Smith ..... B41F 15/0872 101/124
5,660,875 A 8/1997 Muchi et al.
(Continued)

FOREIGN PATENT DOCUMENTS

DE 10 2005 006 732 A1 8/2006
JP 48-62504 8/1973
(Continued)

OTHER PUBLICATIONS

International Search Report dated Jan. 24, 2017 in PCT/JP2016/082221, filed on Oct. 31, 2016 (with English Translation).
Written Opinion dated Jan. 24, 2017 in PCT/JP2016/082221, filed on Oct. 31, 2016.

*Primary Examiner* — Leslie J Evanisko
(74) *Attorney, Agent, or Firm* — Oblon, McClelland, Maier & Neustadt, L.L.P.

(57) ABSTRACT

Provided is a printing plate, containing: a screen plate having an opening pattern; and, a frame body to which the screen plate is fixed, in which the screen plate includes at least one curved part and is relatively movably fixed to the frame body.

21 Claims, 17 Drawing Sheets

(51) Int. Cl.

| | |
|---|---|
| ***B41M 1/12*** | (2006.01) |
| ***B41F 15/30*** | (2006.01) |
| ***B41N 1/24*** | (2006.01) |
| ***B41F 15/42*** | (2006.01) |
| ***B41M 1/40*** | (2006.01) |
| *B41M 1/34* | (2006.01) |
| *B41M 1/38* | (2006.01) |
| *B41M 1/30* | (2006.01) |

(52) U.S. Cl.
CPC ..... *B41F 15/38* (2013.01); *B41F 15/42* (2013.01); *B41F 15/423* (2013.01); *B41M 1/12* (2013.01); *B41M 1/40* (2013.01); *B41N 1/24* (2013.01); *B41M 1/30* (2013.01); *B41M 1/34* (2013.01); *B41M 1/38* (2013.01); *B41N 1/248* (2013.01)

(58) Field of Classification Search
CPC . B41M 1/12; B41M 1/30; B41M 1/34; B41M 1/38; B41M 1/40; H05K 3/1216; H05K 3/1225; H05K 3/1233; B41N 1/24
USPC ..... 101/127, 127.1
See application file for complete search history.

(56) References Cited

U.S. PATENT DOCUMENTS

| | | | | |
|---|---|---|---|---|
| 5,702,526 | A | 12/1997 | Muchi et al. | |
| 5,744,191 | A | 4/1998 | Muchi et al. | |
| 6,041,702 | A | 3/2000 | Ichikawa et al. | |
| 8,561,535 | B2 | 10/2013 | Sabia et al. | |
| 2003/0056665 | A1 | 3/2003 | Tanaka | |
| 2004/0187713 | A1* | 9/2004 | Cutcher | B41F 15/0895 101/35 |
| 2005/0160927 | A1* | 7/2005 | Cutcher | B41F 15/0895 101/127.1 |
| 2011/0209634 | A1 | 9/2011 | Sabia et al. | |

FOREIGN PATENT DOCUMENTS

| | | |
|---|---|---|
| JP | 7-262919 | 10/1995 |
| JP | 9-109364 | 4/1997 |
| JP | 2000-330292 | 11/2000 |
| JP | 3677150 | 7/2005 |
| JP | 2007-169104 | 7/2007 |

* cited by examiner

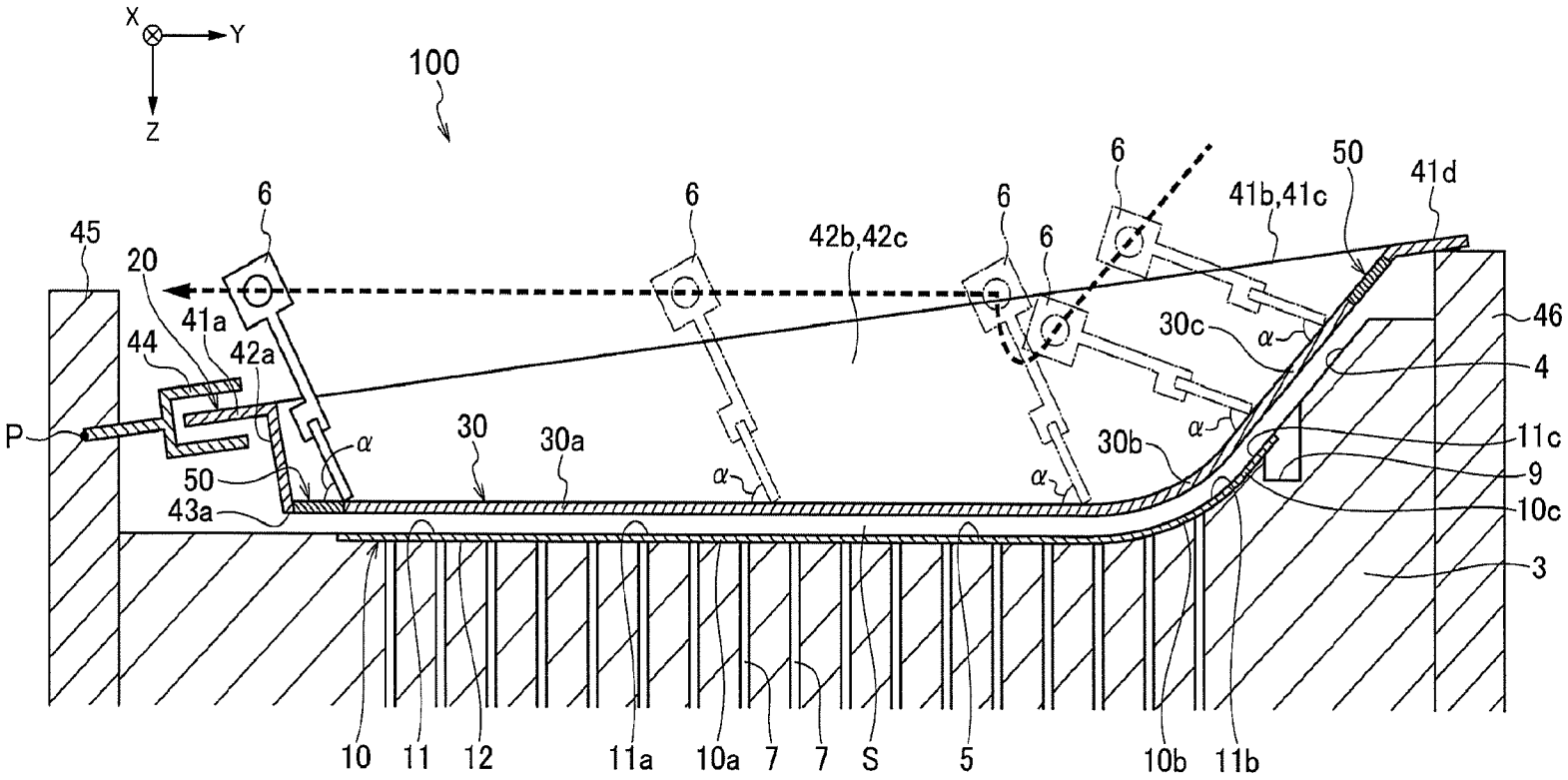
[FIG. 1]

[FIG. 2]
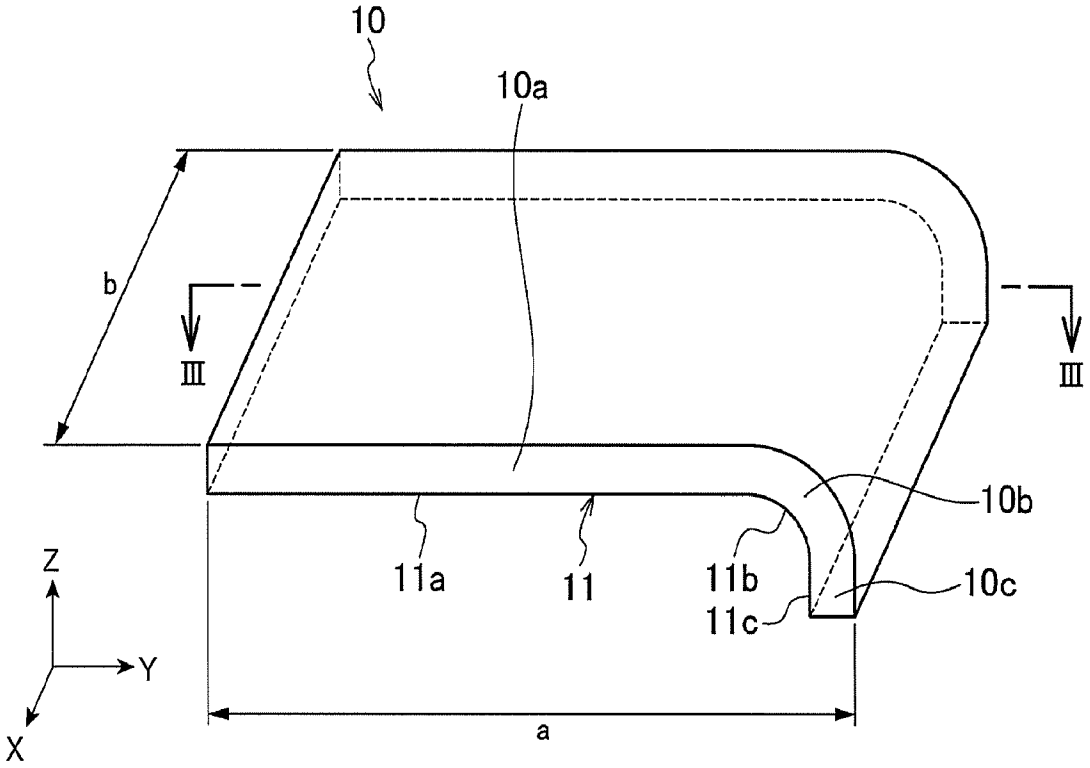

[FIG. 3]
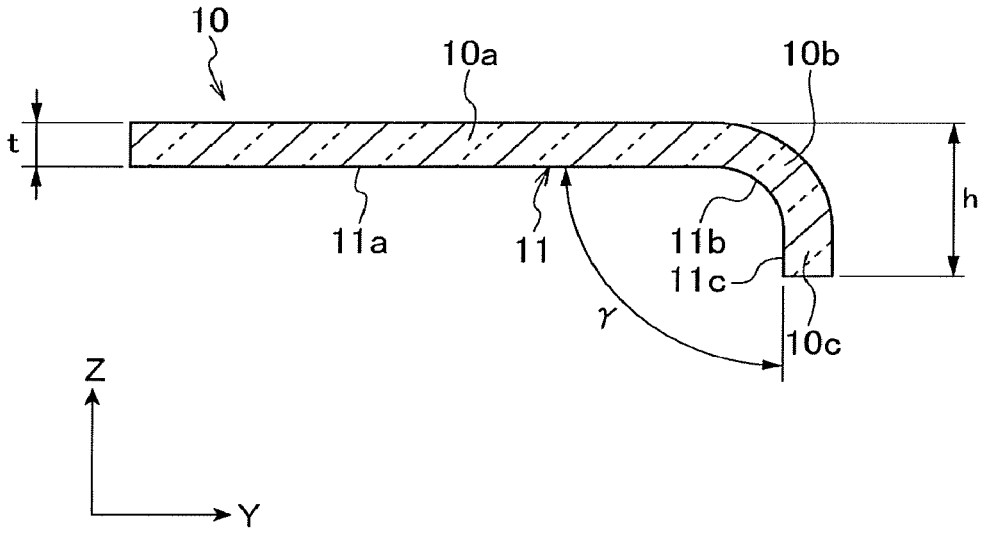
[FIG. 4]
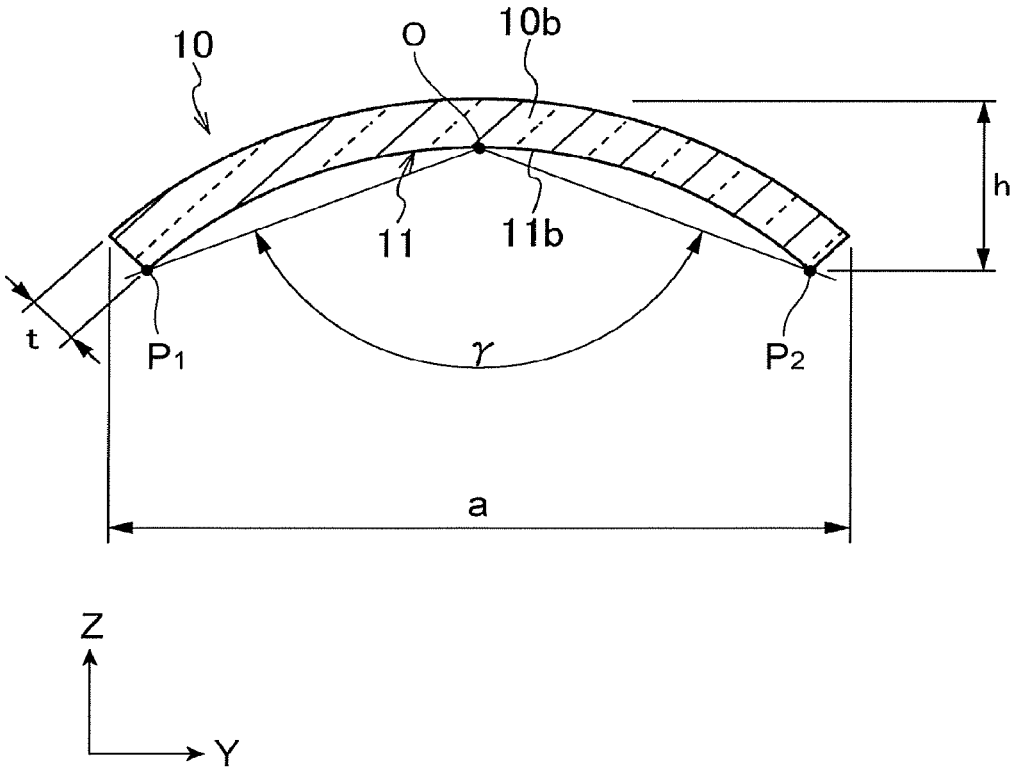

[FIG. 5]
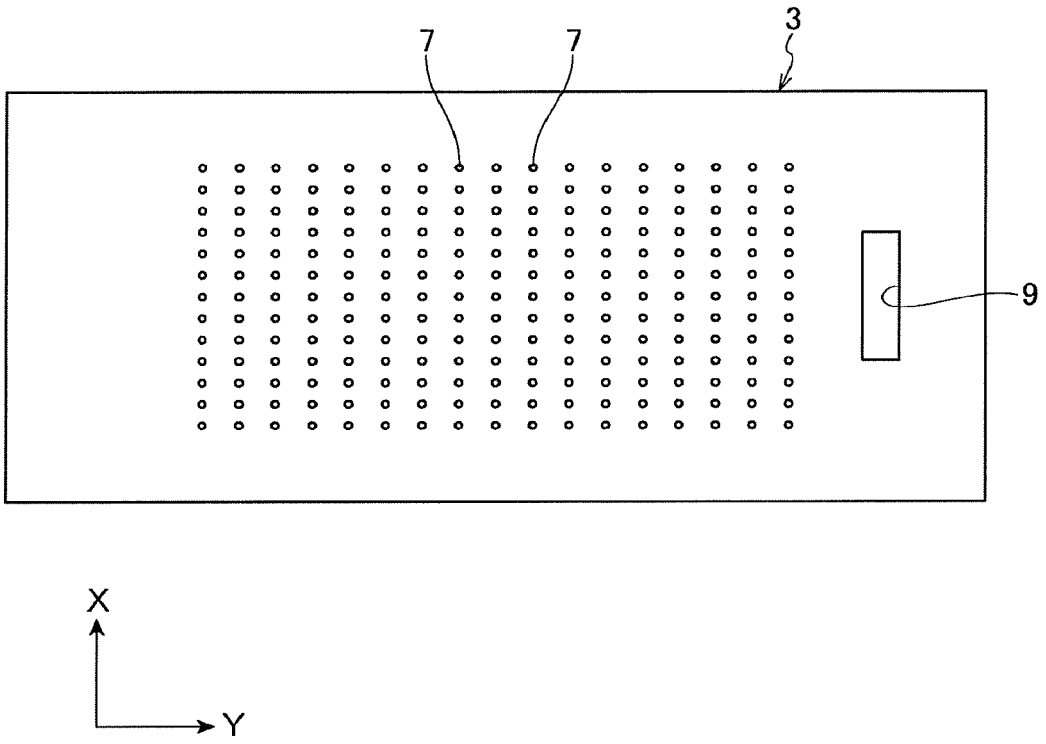

[FIG. 6]
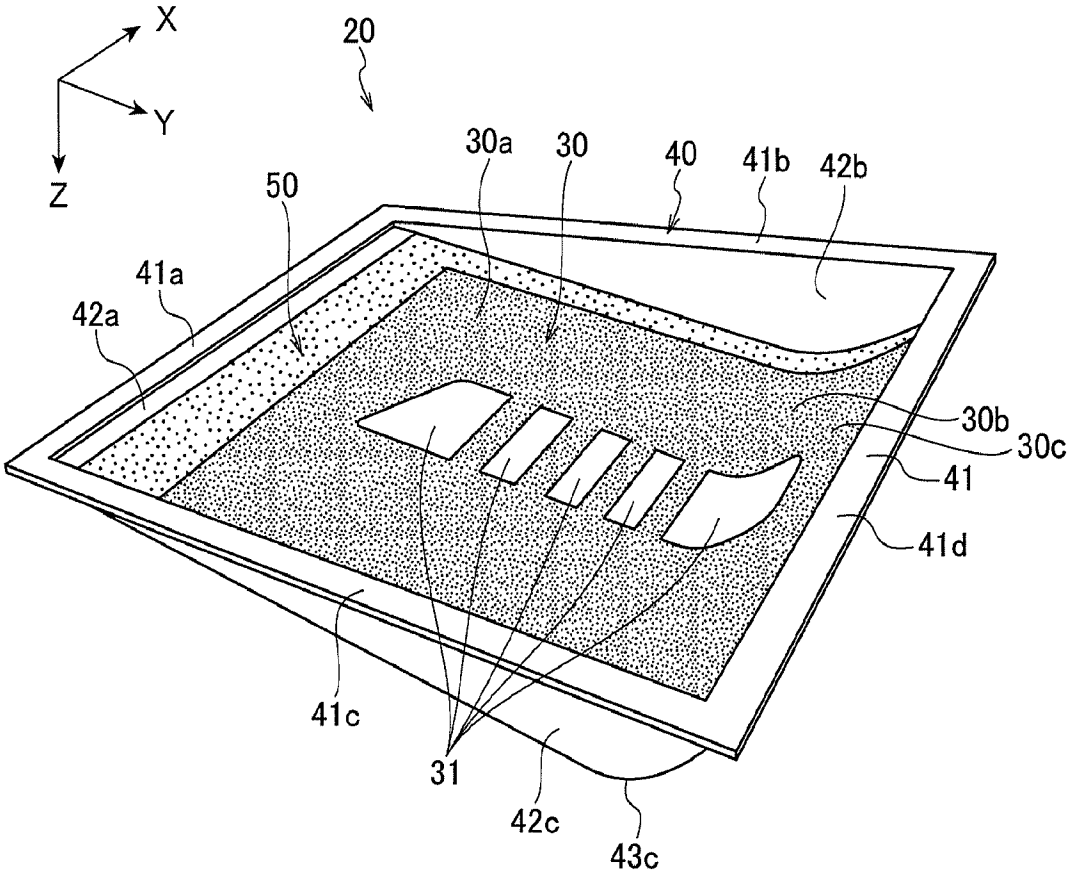

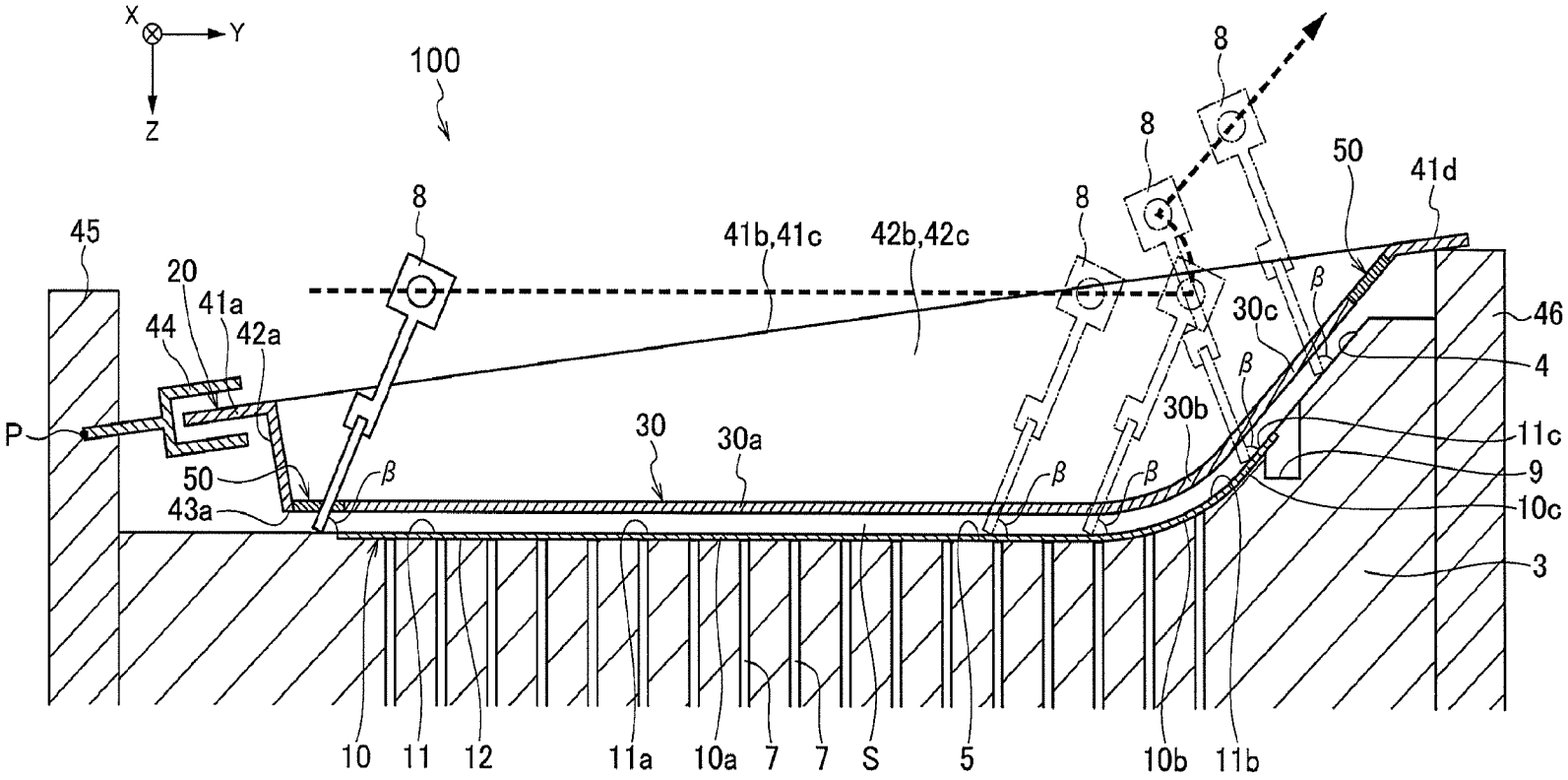
[FIG. 7]

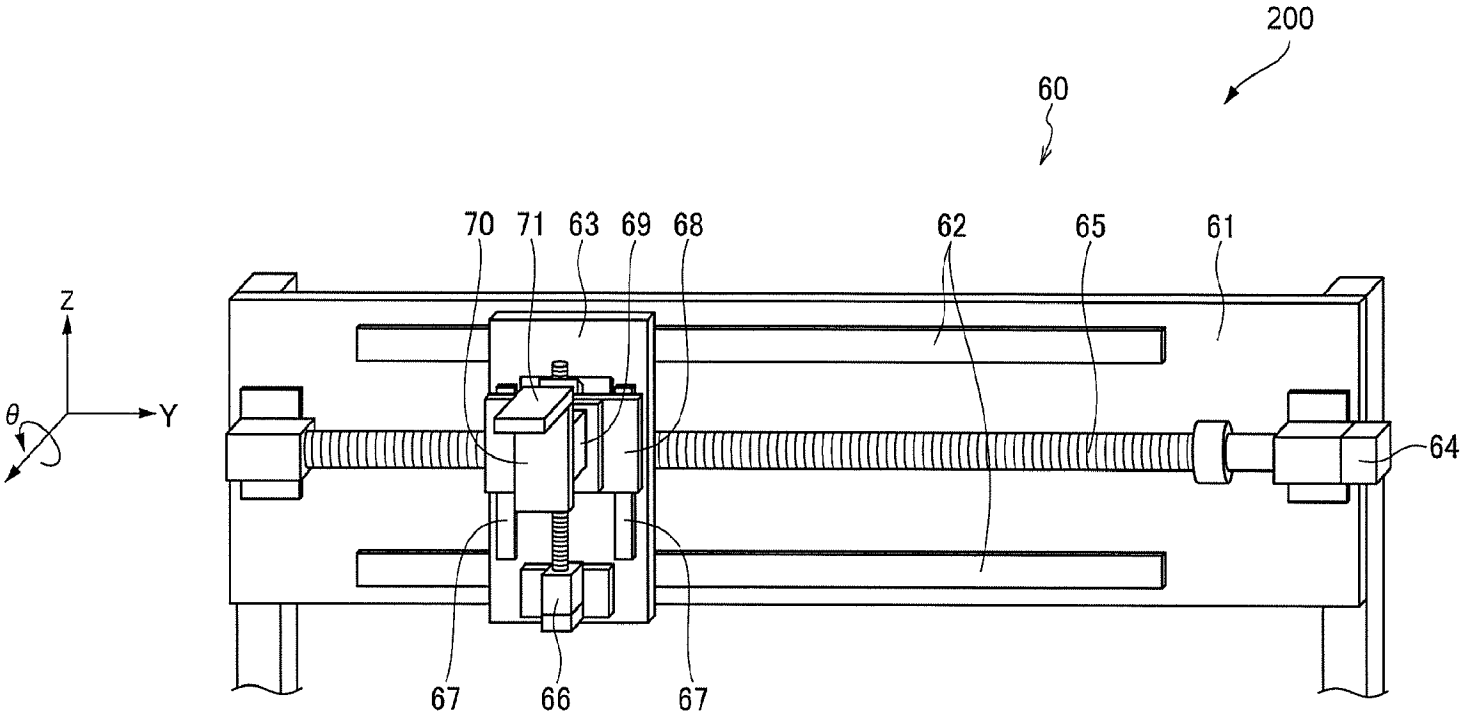
[FIG. 8]

[FIG. 9]
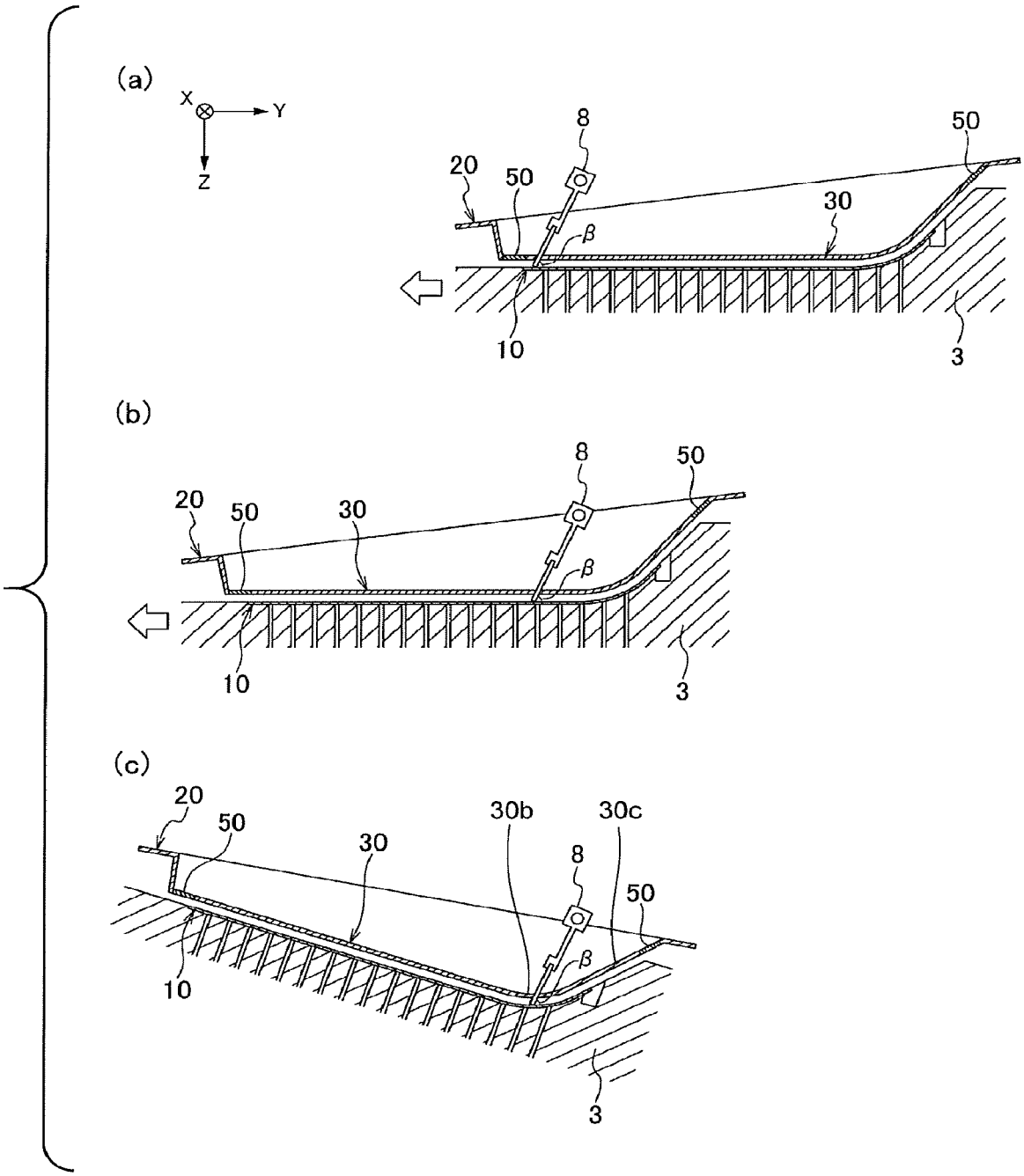

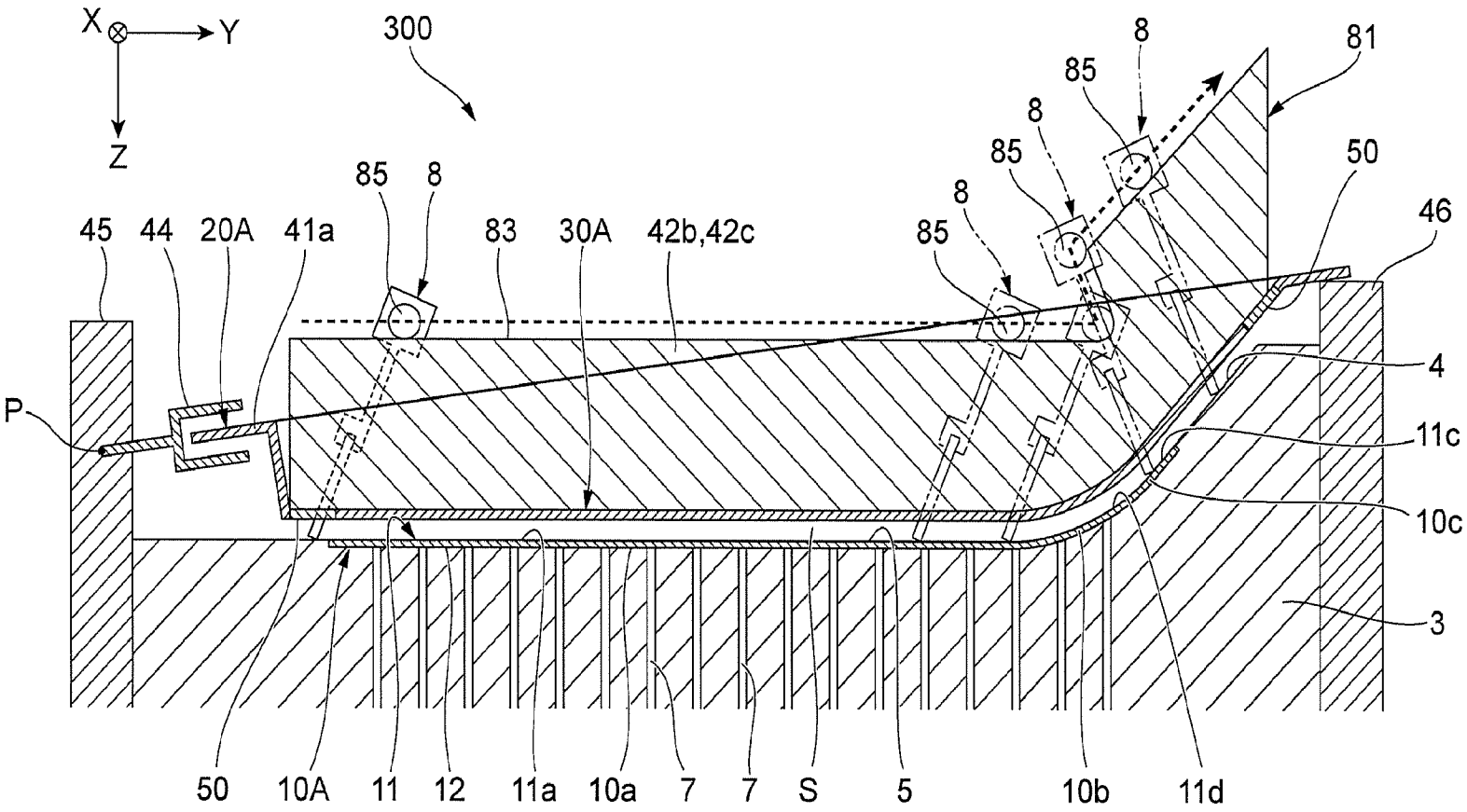
[FIG. 10]

[FIG. 11]
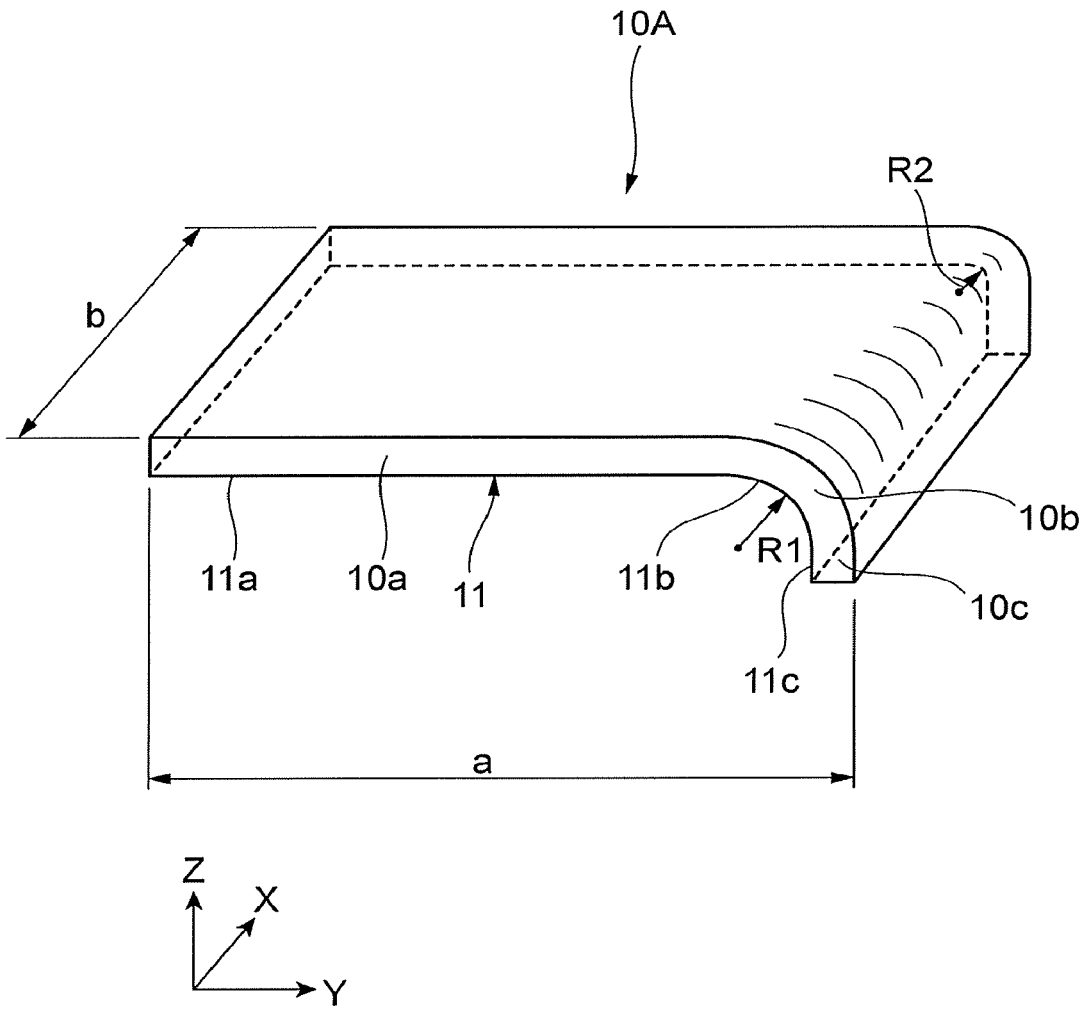

[FIG. 12]
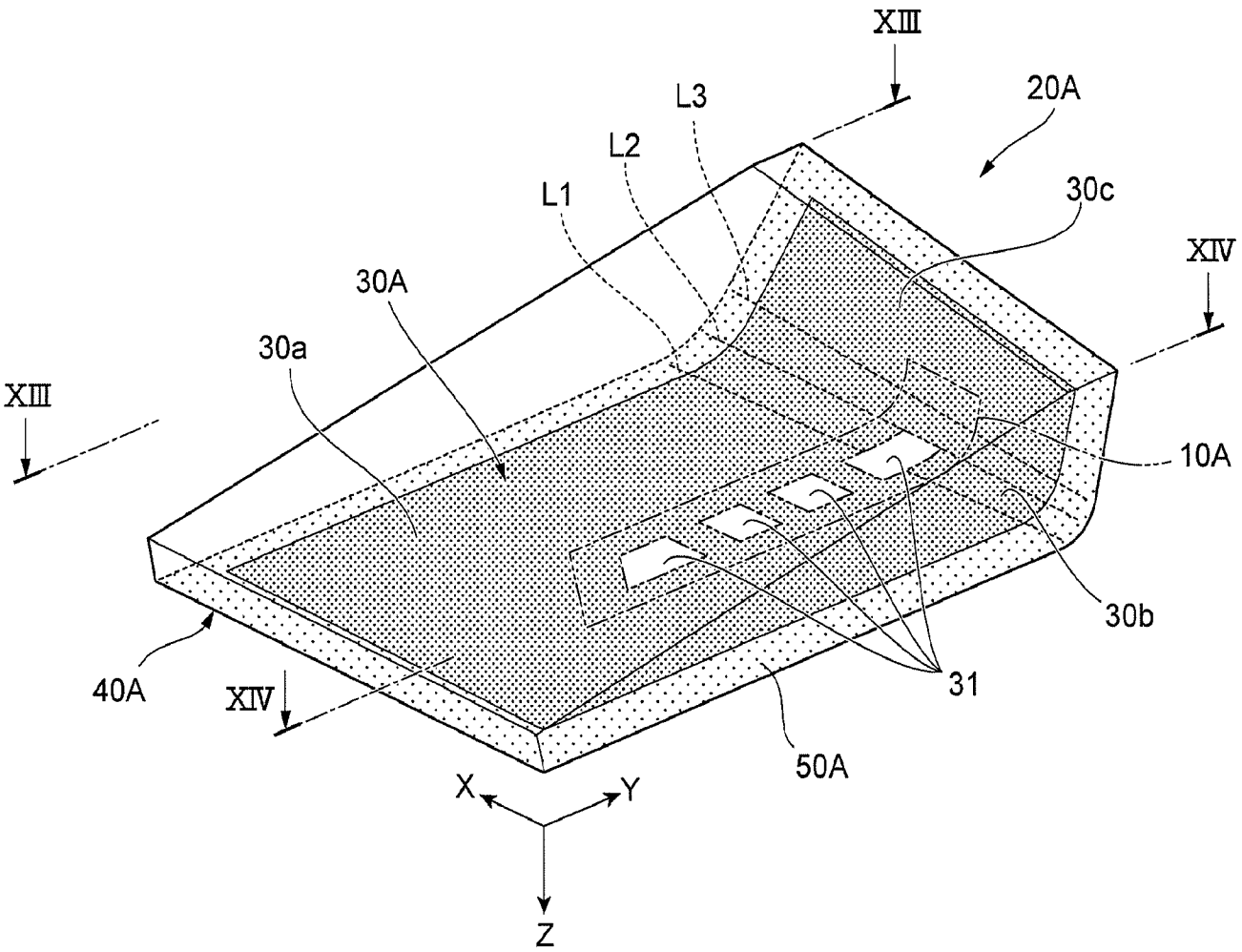

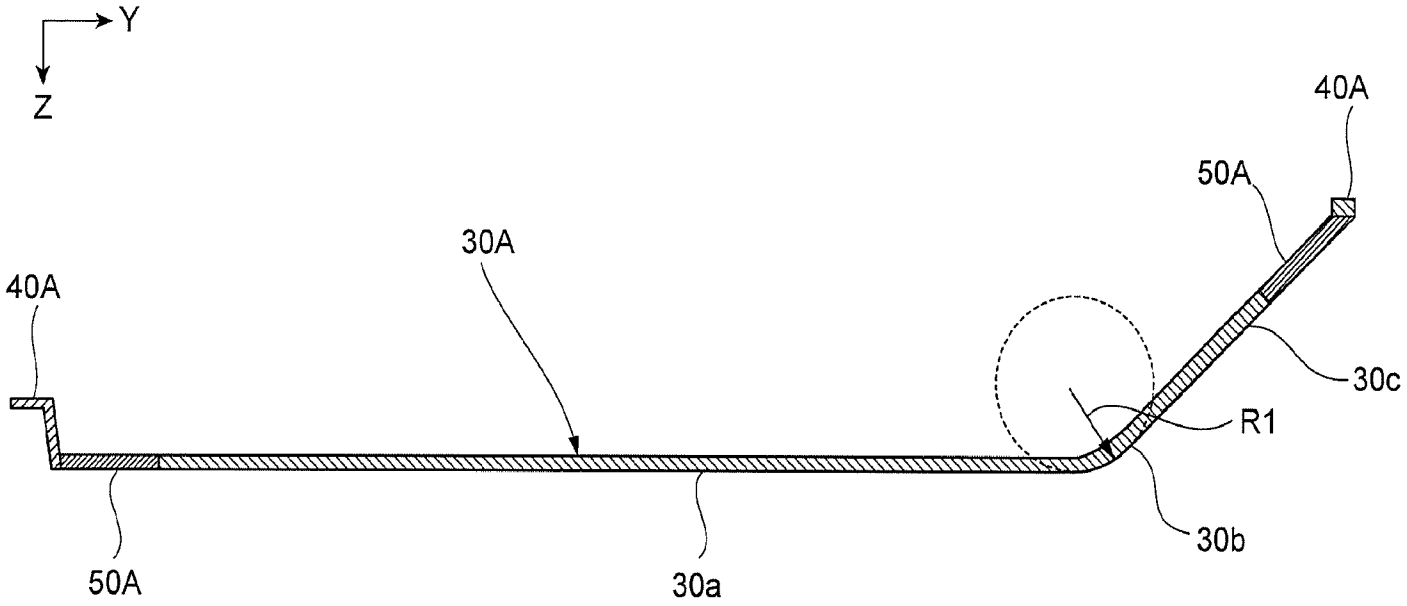
[FIG. 13]

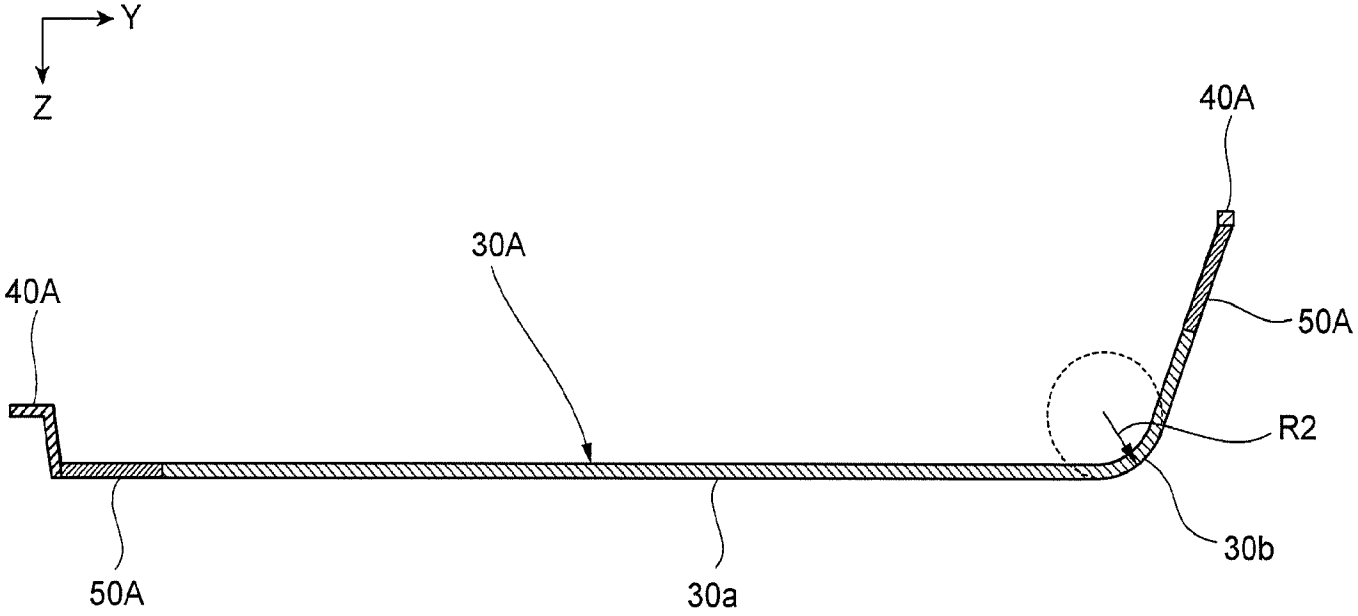
[FIG. 14]

[FIG. 15]
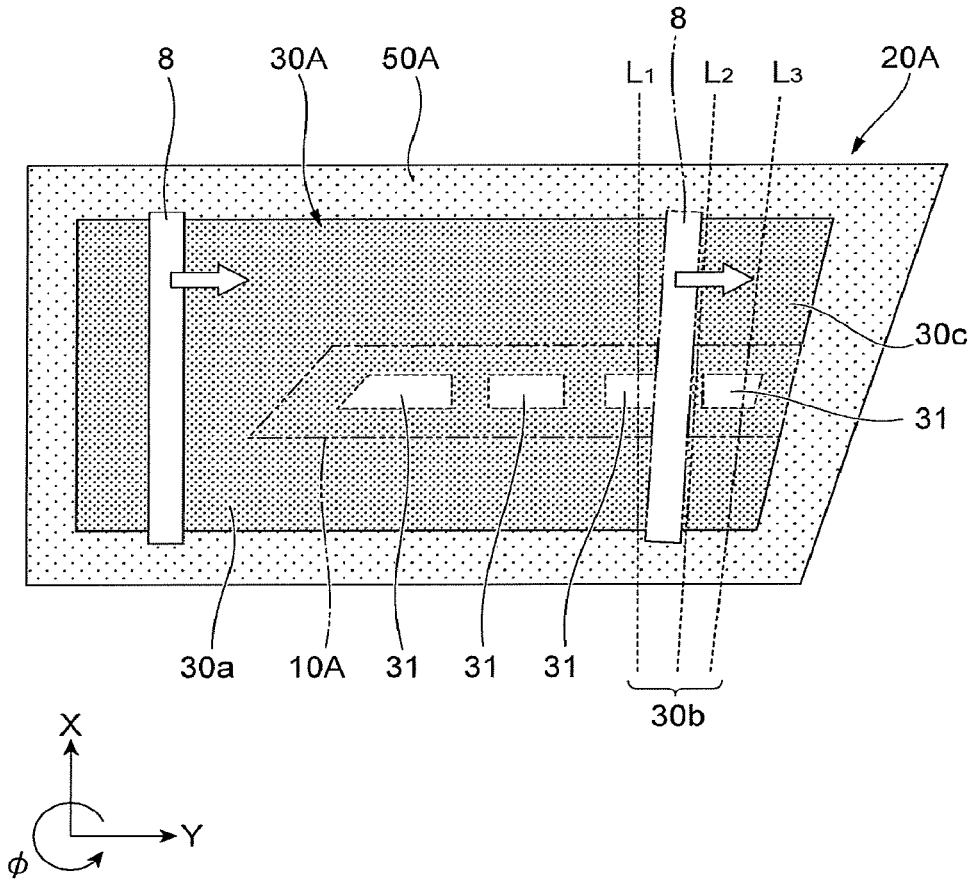

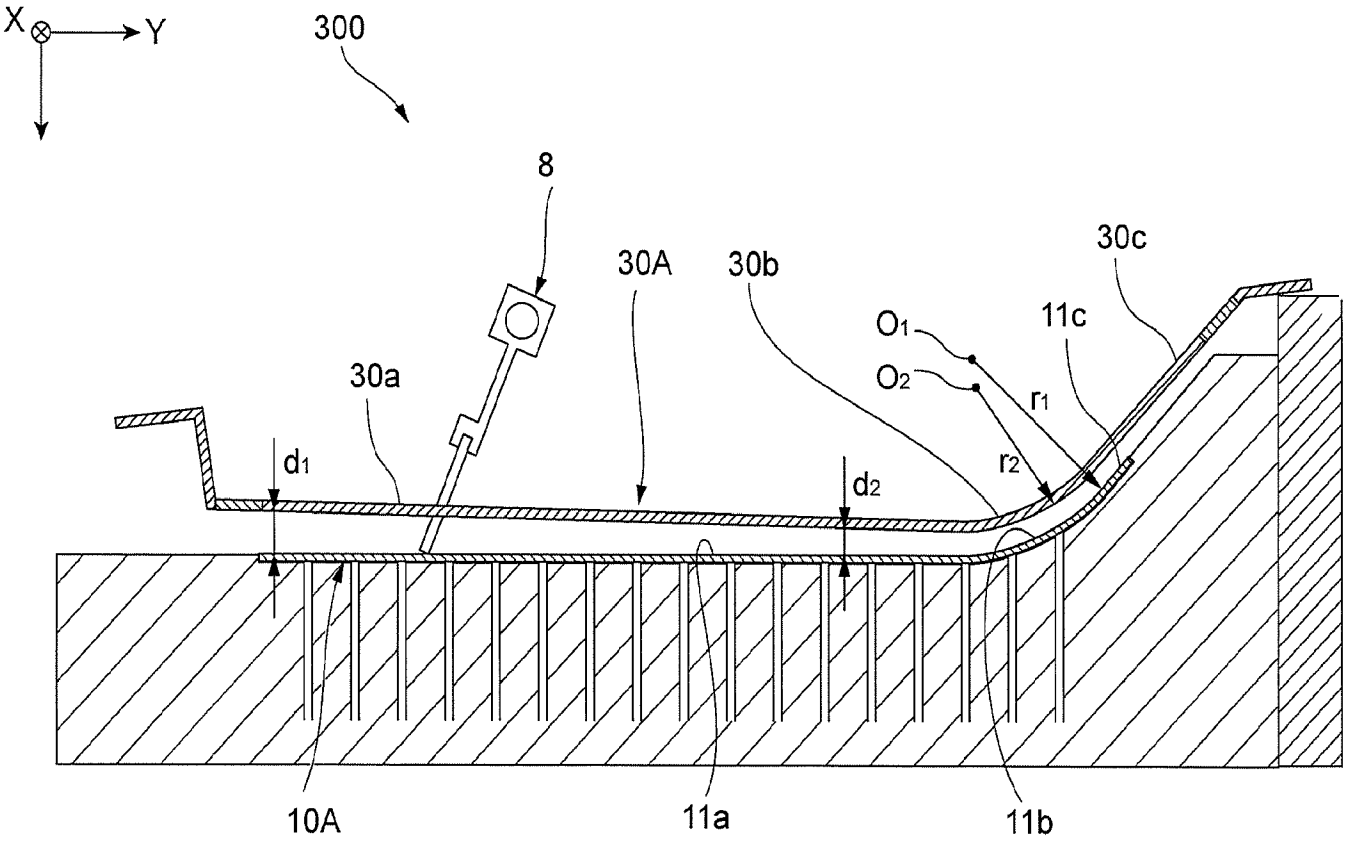
[FIG. 16]

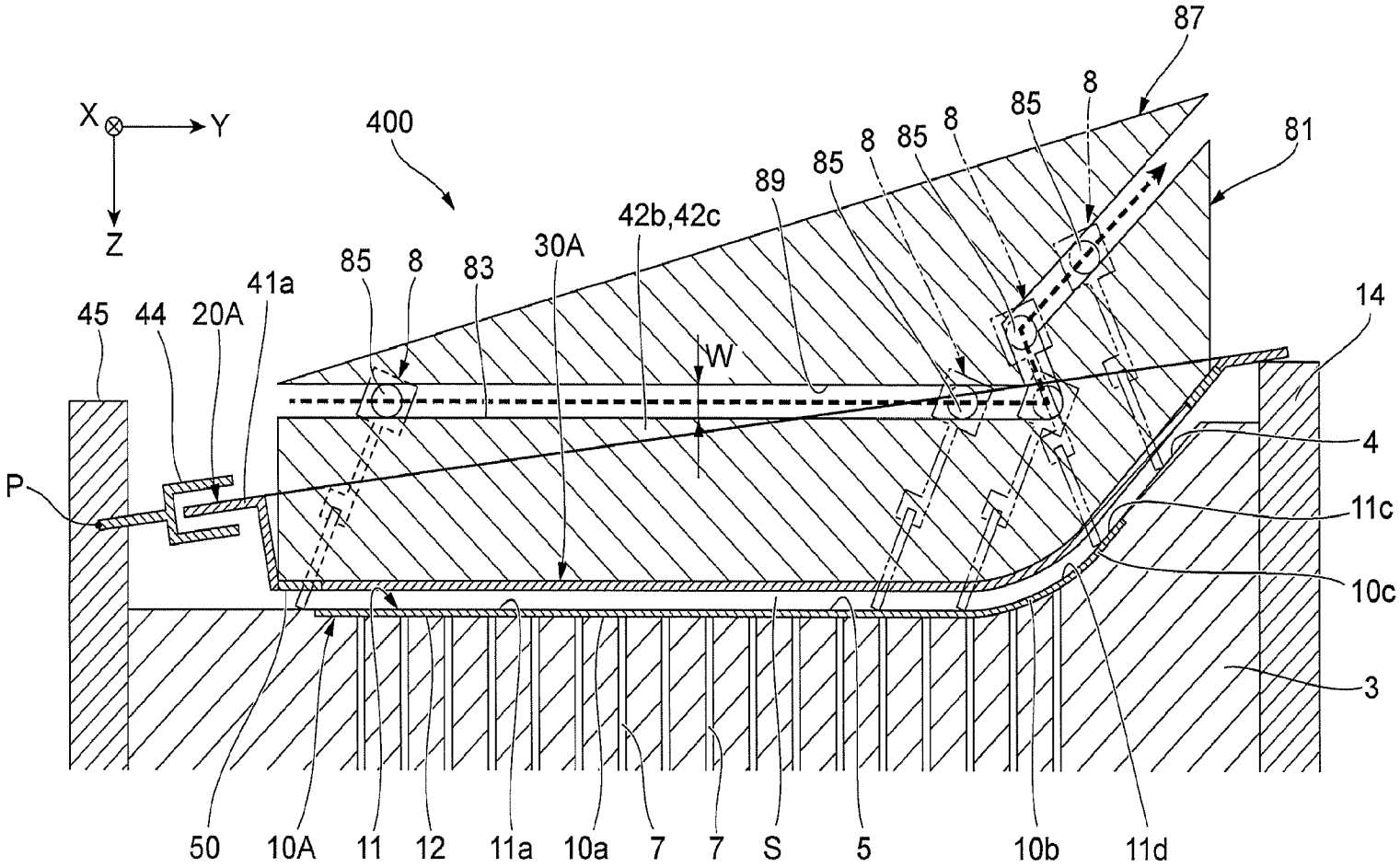
[FIG. 17]

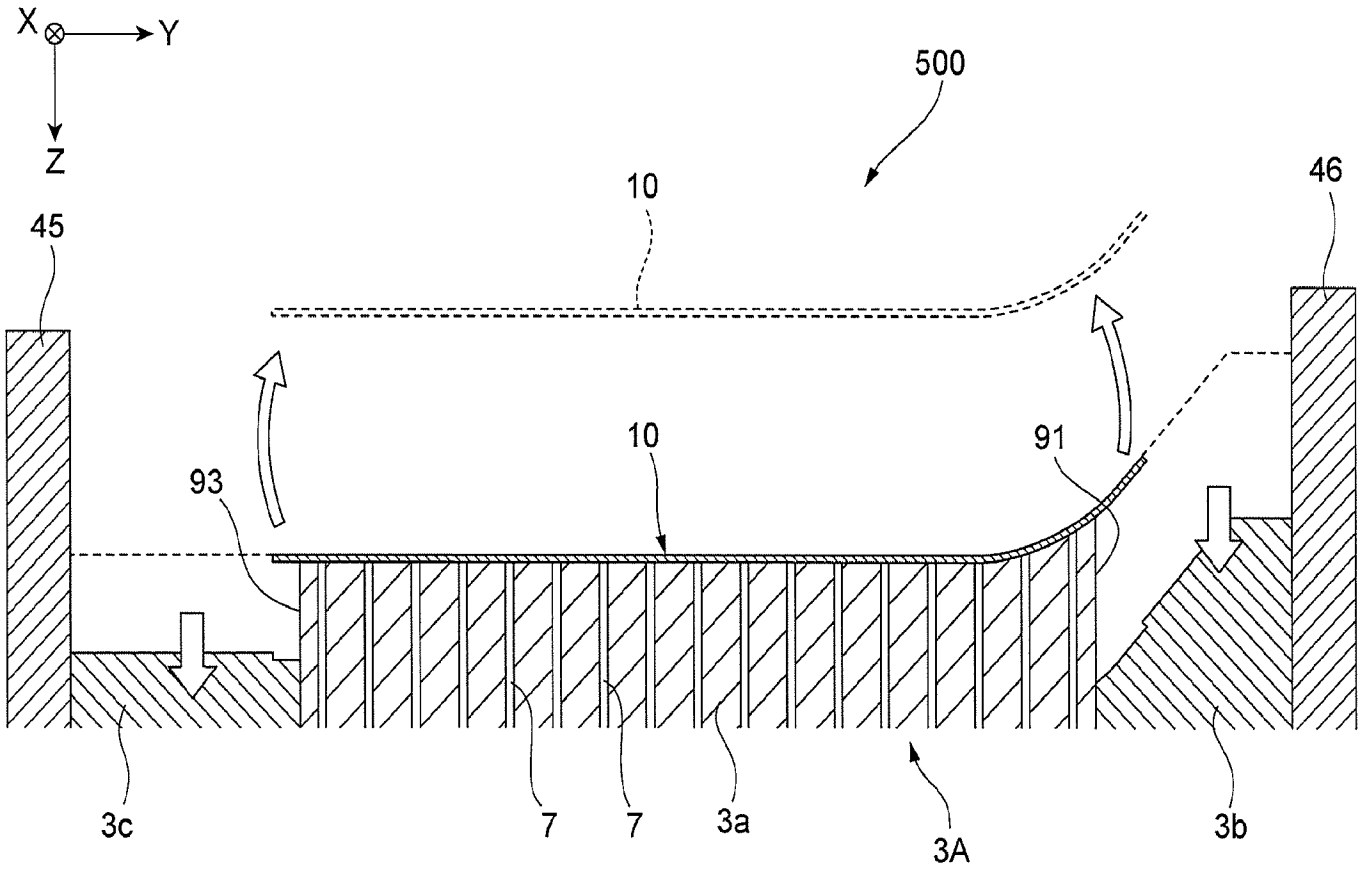
[FIG. 18]

SCREEN PRINTING PLATE, PRINTING DEVICE, AND METHOD FOR MANUFACTURE OF A SUBSTRATE HAVING A CURVED SURFACE

TECHNICAL FIELD

The present invention relates to a printing plate, a printing device, a substrate and a method for manufacturing the substrate.

BACKGROUND ART

There has been known a technology for screen printing on a curved substrate having a curved surface shape (see, e.g., Patent Literatures 1 and 2). Patent Literature 1 discloses a method in which a screen plate is arranged on an upper portion of a surface to be printed having a curved surface shape and the screen plate is pressed by a squeegee to print the surface to be printed. Also, Patent Literature 2 discloses a curved surface screen printing device configured such that a screen plate is rotationally driven according to the curvature of a surface to be printed so that the screen plate always faces a tangential direction with respect to the surface to be printed.

In the printing method disclosed in Patent Literature 1, the screen plate includes a mesh member made of a metal material such as stainless steel or a resin material such as nylon and polyester. While Patent Literature 1 does not describe by what method the screen plate is fixed, normally, the peripheral edge of the screen plate is fixed to a frame body by adhesion or the like.

In the case where the screen plate is made of a metal material such as stainless steel, since it is harder than the case of a screen plate made of a resin material, even when a clearance with respect to an object to be printed is small, good plate removal can be realized. Therefore, it is suitable for high-precision printing. Meanwhile, when the shape of the screen plate is curved so as to fit the shape of an object to be printed having a curved-surface shape, it is necessary to provide a clearance to the extent that a shape error between the screen plate and object to be printed can be absorbed. However, in the case of the screen plate made of a metal material, as described above, a clearance with respect to the object to be printed cannot be set large because the screen plate is hard. Therefore, a clearance capable of absorbing the shape error cannot be secured.

On the whet hand, in the case where the screen plate is made of a synthetic resin such as nylon and polyester, the screen plate is soft and thus the clearance between the screen plate and an object to be printed can be set large as compared with the case of a metal material. Therefore, when the shape of the screen plate is curved so as to fit the shape of the object to be printed, a clearance to such an extent as to absorb a shape error between the screen plate and object to be printed. However, because the screen plate is soft, a tensile force capable of maintaining the curved state cannot be obtained.

Also, in the curved surface screen printing device of Patent Literature 2, in the case where a surface to be printed is a convex curved surface, the screen plate can be rotationally driven so as to follow the convex curved surface. However, it cannot cope with the case where the surface to be printed is a concave curved surface.

CITATION LIST

Patent Literature

Patent Literature 1: U.S. Pat. No. 8,561,535 Specification
Patent Literature 2: JP Patent No 3677150 Publication

SUMMARY OF INVENTION

Technical Problem

Thus, the present invention aims to provide a printing plate, a printing device and a substrate manufacturing method, which can print precisely a surface to be printed having a curved part.

Solution to Problem

The above-described object of the present invention is attained by the following configurations.

(1) A printing plate, containing: a screen plate having an opening pattern; and, a frame body to which the screen plate is fixed, in which the screen plate includes at least one curved part and is relatively movably fixed to the frame body.

(2) The printing plate according to (1), further including a fixing member which is connected to a peripheral edge of the screen plate and whose peripheral edge is fixed to the frame body, in which the screen plate is relatively movably fixed to the frame body by setting an elongation strength of the fixing member smaller than an elongation strength of the screen plate.

(3) The printing plate according to (2), in which the fixing member contains a resin material (4) The printing plate according to (2) or (3), in which the screen plate contains a metal material.

(5) The printing plate according to any one of (1) to (4), in which the screen plate includes at least one plane part.

(6) The printing plate according to any one of (1) to (4), in which a whole surface of the screen plate is curved.

(7) A printing device, containing:

a mounting table on which a substrate having a surface to be printed having at least one curved part is mounted;

the printing plate according to any one of (1) to (6), arranged above the mounting plate; and, a squeegee arranged above the screen plate of the printing plate and capable of pushing out a printing material to the surface to be printed through the opening pattern of the screen plate.

(8) The printing device according to (7), in which the at least one curved parts of the screen plate and of the substrate are respectively concave curved parts.

(9) The printing device according to (7) or (8), further containing a squeegee drive mechanism capable of moving the squeegee relative to the screen plate, the substrate and the mounting table so that an angle formed by the surface to be printed and the squeegee is constant.

(10) The printing device according to any one of (7) to (9), further containing a squeegee drive mechanism capable of moving the squeegee relative to the screen plate, the substrate and the mounting table so that a pressing force of the squeegee with respect to the screen plate is constant.

(11) The printing device according to (9) or (10), in which the squeegee drive mechanism includes a rotation shaft capable of rotating the squeegee.

(12) The printing device according to any one of (7) to (11), further containing a scraper arranged above the screen plate of the printing plate and spreading the printing material onto the screen plate.

(13) The printing device according to (11) or (12), in which the printing plate includes a guide member having a guide surface supporting both ends of direction of the rotation shaft, and the squeegee performs the relative movement while cam followers provided on the both ends of direction of the rotation shaft are in rolling contact with the guide surface.

(14) The printing device according to (13), further containing a pressing member provided so as to face the guide member and forming a clearance with the guide surface, guiding the cam followers.

(15) The printing device according to any one of (7) to (14), in which the mounting table includes a mounting table main body supporting a central part of the substrate and a retraction block supporting the end of the substrate, and the retraction block is capable of moving upward and downward relative to the mounting table main body.

(16) The printing device according to any one of (7) to (15), in which the substrate is a glass plate.

(17) A method for manufacturing a substrate containing a surface to be printed having at least one curved part and a printed layer formed on the surface to be printed, including:

a printing plate containing a screen plate having an opening pattern and a frame body to which the screen plate is fixed, and arranged above the substrate and a squeegee arranged above the screen plate of the printing plate, in which the screen plate has at least one curved part and is relatively movably fixed with respect to the frame body, the method containing pushing out a printing material to the surface to be printed through the opening pattern of the screen plate by the squeegee.

(18) The method for manufacturing a substrate, according to (17), containing, when pushing out the printing material to the surface to be printed, moving the squeegee relative to the screen plate and the substrate so that an angle formed by the surface to be printed and the squeegee is constant.

(19) The method for manufacturing a substrate, according to (17) or (18), containing, when pushing out the printing material to the surface to be printed, moving the squeegee relative to the screen plate and the substrate so that a pressing force of the squeegee to be applied to the screen plate is constant.

(20) The method for manufacturing a substrate, according to any one of (17) to (19), further including a scraper arranged above the screen plate of the printing plate, the method containing, before pushing out the printing material to the surface to be printed, spreading the printing material onto the screen plate by the scraper.

(21) The method for manufacturing a substrate, according to (20), containing, when spreading the printing material onto the screen plate, moving the scraper relative to the screen plate so that a contact angle of the scraper with respect to the screen plate is constant

(22) The method for manufacturing a substrate, according to (20) or (21), containing, when spreading the printing material onto the screen plate, moving the scraper relative to the screen plate so that a pressing force of the scraper to be applied to the screen plate is constant.

(23) A substrate including: a surface to be printed having at least one curved part and a printed layer formed on the surface to be printed, in which the curved part has a curving depth of 10 mm or more.

(24) The substrate according to (23), in which the at least one curved part is a concave curved shape.

(25) The substrate according to (23) or (24), wherein the printed layer has a thickness deviation of ±10% with respect to the average thickness thereof.

Advantageous Effects of Invention

The present invention can achieve an accurate printing with respect to a surface to be printed having a curved part.

BRIEF DESCRIPTION OF DRAWINGS

FIG. 1 It is a cross-sectional view of main parts of a printing device having a first configuration example, illustrating a state where a scraper is rotated and displaced to spread printing material.

FIG. 2 It is a perspective view schematically illustrating the appearance of a substrate.

FIG. 3 It is a cross-sectional view taken along the line of FIG. 2.

FIG. 4 It is a cross-sectional view of a substrate whose surface to be printed is formed of only one curved portion.

FIG. 5 It is a plan view of a mounting table.

FIG. 6 It is a perspective view of a printing plate.

FIG. 7 It is a cross-sectional view of main parts of a printing device having a first configuration example, illustrating a state where a squeegee is rotated and displaced for printing.

FIG. 8 It is a configuration view of a moving mechanism included in a printing device having a second configuration example.

FIGS. 9 (*a*), (*b*) and (*c*) are process explanatory views, illustrating a state where a mounting table, a substrate and a printing plate are rotated and displaced by a push-out process performed by the printing device of the second configuration example.

FIG. 10 It is a cross-sectional view of main parts of a printing device having a third configuration example, illustrating a state where a squeegee is rotated and displaced for printing.

FIG. 11 It is a perspective view schematically illustrating the appearance of a twisted substrate.

FIG. 12 It is a perspective view of a printing plate for printing on such a twisted substrate as illustrated in FIG. 11.

FIG. 13 It is a cross-sectional view taken along the line of FIG. 12.

FIG. 14 It is a cross-sectional view taken along the XIV-XIV line of FIG. 12.

FIG. 15 It is a top surface view of the screen plate illustrated in FIG. 12.

FIG. 16 It is a cross-sectional view of main parts of the printing device having the third configuration example.

FIG. 17 It is a cross-sectional view of main parts of a printing device having a fourth configuration example, illustrating a state where a squeegee is rotated and displaced for printing.

FIG. 18 It is a cross-sectional view of main parts of a printing device having a fifth configuration example, illustrating a configuration example of another mounting table.

DESCRIPTION OF EMBODIMENTS

Hereinafter, a printing plate, a printing device and a method for manufacturing a substrate according to embodiments of the present invention will be described specifically with reference to the drawings.

First Configuration Example

FIG. 1 is a cross-sectional view of main parts of a printing device 100 having a first configuration example, illustrating a state where a scraper rotates and displaces to spread printing material onto a screen plate.

The printing device 100 includes a mounting table 3 on which a substrate 10 having a surface 11 to be printed is to be mounted, a printing plate 20 to be arranged above the mounting table 3, and a scraper 6 and a squeegee, which is described later, respectively capable of moving on the printing plate 20. Hereinafter, the thickness direction (the vertical direction in FIG. 1) of the substrate 10 is called 7 direction, a direction which is orthogonal to the Z direction and in which the scraper 6 moves is called Y direction, and a direction orthogonal to the Z direction and the Y direction is called X direction.

(Substrate)

The substrate 10 has a surface 11 (upper surface) to be printed and a lower surface 12 facing the surface 11 to be printed. In the substrate 10 of this configuration example, the surface 11 to be printed and the lower surface 12 are parallel to each other but need not necessarily be parallel. The substrate 10 is a curved substrate having a three-dimensionally curved shape and includes a curved part at least in a part of the surface 11 to be printed. The term "curved part" means a part whose mean radius of curvature is not infinite and, specifically, means a part having a radius of curvature being 1,000 mm or less. Here, the substrate 10 may also be formed in such a shape that the whole surface of the substrate 10 is curved.

The substrate 10 of this configuration includes a first plane part 10*a* extending in parallel to the XY surface from one end toward the other end in the Y direction, a curved part 10*b* connected to the first plane part 10*a* and curved in the Z direction (upward in the drawing), and a second plane part 10*c* connected to the curved part 10*b* and extending to the other end in the Y direction (rightward in the drawing). And, the surface 11 to be printed of the substrate 10 includes a first plane part 11*a* parallel to the XY surface, a curved part 11*b* connected to the first plane part 11*a* and curved in the Z direction (upward in the drawing), and a second plane part 11*c* connected to the curved part 11*b* and extending to the other end in the Y-direction (rightward in the drawing), in such a manner that they respectively correspond to the first plane part 10*a*, curved part 10*b* and second plane part 10*c*.

FIG. 2 is a perspective view schematically illustrating the appearance of the substrate 10, and FIG. 3 is a cross-sectional view taken along the line of FIG. 2.

Here, in the substrate 10 including the first plane part 10*a*, curved part 10*b* and second plane part 10*c*, the X direction dimension is denoted as "a", Y direction dimension is denoted as "b", and thickness is denoted as "t". Also, as illustrated in FIG. 3, the distance between the two ends of the substrate 10 in the curved direction (in this example, in the Z direction) of the substrate 10 is called a curving depth h. The curving depth h is preferably 5 mm or more and 500 mm or less, more preferably 10 mm or more and 300 mm or less, further preferably 20 mm or more and 300 mm or less, and particularly preferably 10 mm or more and 100 mm or less.

Here, the surface 11 to be printed only has to have at least one curved part 11*b* formed, while the position, number, shape, and the like of the curved part 11*b* are not limitative. For example, the curved part 11*b* may not be formed in such a concave-curved shape that the surface 11 to be printed provides a concave surface as illustrated in FIG. 1, but may be formed in such a convex-curved shape that the surface 11 to be printed provides a convex surface.

Also, as illustrated in FIG. 3, an angle formed at a point of intersection where the extension lines of respective planes of the first plane part 11*a* and second plane part 11*c* of the surface 11 to be printed intersect is defined as an "opening angle γ". The opening angle γ of the substrate 10 is preferably 45° or more and 315° or less, and more preferably 90° or more and 270° or less (except in the case of 180°).

Furthermore, the substrate 10, as illustrated in FIG. 4, may be configured such that the surface 11 to be printed is formed of only one curved part 11*b*. The curving depth h of this substrate 10 is the distance between a line segment connecting together the Z-direction lower ends P1 and P2 of the substrate 10 and a tangent at the bottom (the outside surface of the concave-curved surface) of the substrate 10 extending in parallel to the line segment. Also, when a point where a line parallel to the line segment connecting P1 and P2 comes into contact with the bottom (the inside surface of the concave-curved surface) of the substrate 10 is defined as a contact point O, the opening angle γ of the substrate 10 is defined as an angle formed by line segments which respectively connect together the contact point O and the Z-direction lower ends P1 and P2.

Here, the X-direction dimension a, Y-direction dimension b and thickness t of the substrate 10 are not limited particularly. The whole area of the substrate 10 preferably has a substantially constant thickness t. Also, the thickness t may vary partially or may vary across the substrate 10.

Examples of the substrate 10 include a plate made of glass, a ceramic, resin, wood, metal, and the like and, in particular, examples of the glass plate include crystalized glass plate, colored glass plate and the like besides transparent amorphous glass plate. A glass plate serving as a curved substrate can be used in various uses and, in particular, it can be suitably used by being mounted in a transportation machine such as an automobile, an electric train, a ship, and an aircraft. Also, in the case where the substrate 10 is used in an interior part of the transportation machine, such as an instrumental panel, a head-up display (HUD), a dash board, a center console, and a shift knob, it can impart high design and luxury feeling to the interior part and can enhance the design of the interior of the transportation machine.

(Mounting Table)

As illustrated in FIG. 1, in the upper surface 4 of the mounting table 3, there is formed a groove 5 having a shape substantially the same as the substrate 10. In a state where the substrate 10 is mounted on the groove 5, the surface 11 to be printed of the substrate 10 projects slightly more upward in the 7 direction than the upper surface 4 of the mounting table 3. This projection of the substrate 10 prevents a screen plate 30 from corning into contact with the upper surface 4 of the mounting table 3 and the like, thereby providing an effect of preventing the substrate 10 from being contaminated by the printing material. The projection amount of the surface 11 to be printed of the substrate 10 from the upper surface 4 of the mounting plate 3 is preferably from 0.1 to 1 mm, more preferably from 0.1 to 0.5 mm or less, and further preferably from 0.1 to 0.2 mm.

The mounting table 3 is made of carbon, resin or the like. Examples of the resin include BAKELITE (registered trademark), PEEK (registered trademark), vinyl chloride, and DURACON (registered trademark). Such resin may be subjected to a surface treatment using a conductive film and the like for imparting conductivity thereto, or may be mixed with conductivity imparting material such as carbon. The mounting table 3 (at least the upper surface 4 of the mounting table 3) has a volume resistivity of desirably $10^9$ Ωm or less, and more desirably $10^7$ Ωm to $10^8$ Ωm. In the case where the volume resistivity is within the above range, static electricity generated during printing is suppressed, thereby enhancing plate removal of a screen plate 30 (to be discussed later) from the surface 11 to be printed. Furthermore, stopping of the printing material such ink becomes more easily and thus, printing accuracy can be enhanced without contamination of the screen plate 30. Also, since static electricity can be reduced, foreign matter such as dust is not attracted and a good printed layer can be formed.

The method of fixing the substrate 10 to the mounting table 3 is not limited to above-mentioned engagement thereof with the groove 5, and vacuum suction or the combination of both can be employed.

FIG. 5 is a plan view of the mounting table 3. As illustrated in FIG. 1 and FIG. 5, in the groove 5 on the upper surface 4 of the mounting table 3, multiple vacuum holes 7 are opened, while each vacuum hole 7 extends in the Z direction and is connected to a vacuum device not illustrated (e.g., a vacuum pump). When the external air is sucked from the vacuum holes 7 by the vacuum device, the substrate 10 is vacuum-sucked to the mounting table 3. Here, the mounting table 3 illustrated in FIG. 1 illustrates a configuration example in which the engagement of the substrate 10 with the groove 5 and the vacuum suction thereof are used in combination.

Also, in the upper surface of the mounting table 3, a recess 9 is formed at a position through which the edge portion (in this embodiment, one side of the substrate 10) of the substrate 10 passes. The lower surface 12 of the substrate 10 as exists in the edge portion thereof is arranged in the opening of the recess 9 so as to face it. The recess 9 is formed in order that, after printing of the substrate 10, a hand, a spatula or the like is inserted therein to lift the substrate 10 and remove the substrate 10 from the mounting table 3 without touching the surface 11 to be printed. Therefore, the recess 9 has a size capable of inserting therein a hand, a spatula or the like and, in this configuration, it is formed along one side of the substrate 10.

Furthermore, in order that the substrate 10 is made difficult to move within the XY surface or the like, an abutment member may also be provided on the mounting table 3. In this case, the end face of the substrate 10 is fixed and, even when a printing process is performed, the substrate 10 is difficult to move, thereby enhancing printing accuracy.

(Printing Plate)

Above the mounting table 3 in the Z direction, there is arranged a printing plate 20 which performs screen printing on the surface 11 to be printed of the substrate 10.

FIG. 6 is a perspective view of the printing plate 20.

The printing plate 20 includes a screen plate 30 having an opening pattern frame body 40 to the inside of which the screen plate 30 is to be fixed, and a fixing member 50 whose inner peripheral portion is to be connected to the peripheral edge of the screen plate 30 and whose outer peripheral portion is to be fixed to the frame body.

The frame body 40 includes a square upper frame 41 which extends so as to incline upward in the Z direction as it goes from the left end toward the right end in the Y direction. The upper frame 41 includes a first upper frame piece 41*a* positioned in left end thereof in the Y direction, a second upper frame piece 41*b* and a third upper frame piece 41*c* respectively connected to the X-direction both ends of the first upper frame piece 41*a* and extending to the Y-direction right end, and a fourth upper frame piece 41*d* connecting together the Y-direction right ends of the second upper frame piece 41*b* and third upper frame piece 41*c*.

On the inner peripheral side (on the side of the screen plate 30) of the lower surfaces of the first upper frame piece 41*a*, second upper frame piece 41*b* and third upper frame piece 41*c*, there are formed a first side wall 42*a*, a second side wall 42*b* and a third side wall 42*c* which respectively extend downward in the Z direction so as to be orthogonal to the first upper frame piece 41*a*, second upper frame piece 41*b* and third upper frame piece 41*c*. The X-direction both ends of the first side wall 42*a* are connected to the second side wall 42*b* and third side wall 42*c*, respectively. Also, the lower surfaces 43*a*, 43*c* of the first side wall 42*a*, second side wall 42*b* and third side wall 42*c* (the lower surface of the second side wall 42*b* is not illustrated) provide surfaces which extend along the surface 11 to be printed of the substrate 10 and the upper surface 4 of the mounting table 3 illustrated in FIG. 1.

As illustrated in FIG. 1, the upper and lower surfaces of the first upper frame piece 41*a* are sandwiched by a clamp 44. A support portion of the clamp 44 as exists on the opposite side to the side thereof for sandwiching the first upper frame piece 41*a* is connected to a support rod 45 extending in the Z direction. The clamp 44 is supported so as to be rotatable on the YZ plane about a connecting point P to the support rod 45.

Although the fourth upper frame piece 41*d* is not fixed, the lower surface thereof is supported on the upper end of a height-adjusting support rod 46 extending in the Z direction. The height-adjusting support rod 46 adjusts the height of the printing plate 20 (screen plate 30, frame body 40, and fixing member 50) to adjust a clearance S between the screen plate 30 and substrate 10.

The printing plate 20, after printing by the screen plate 30, is rotated about the connecting point P in a direction to move away from the substrate 10 (counterclockwise direction in the drawing) to be retracted. Then, the printed substrate 10 is removed from the mounting table 3 and another substrate 10 to be printed next can be set on the mounting table 3.

The screen plate 30 is fixed to the inner peripheral side of the frame body 40 and has a shape to correspond to the surface 11 to be printed of the substrate 10 and the upper surface of the mounting table 3. That is, the screen plate 30 is arranged on the surface 11 to be printed of the substrate 10 and the upper surface 4 of the mounting table 3 through a substantially constant clearance S, and is arranged in parallel to the surface 11 to be printed of the substrate 10 and the upper surface 4 of the mounting table 3. In other words, just as the substrate 10 includes the first plane part 10*a*, curved part 10*b* and second plane part 10*c*, the screen plate 30 also has a similar shape. That is, the screen plate 30 includes a first plane part 30*a* arranged in parallel to the XY plane, a curved part 30*b* connected to the first plane part 30*a* and extending so as to incline upward in the Z direction as it goes toward the Y-direction right end thereof, and a second plane part 30*c* connected to the curved part 30*b* and extending so as to incline upward in the Z direction as it goes toward the Y-direction right end thereof. Here, the clearance S between the screen plate 30 and the surface 11 to be printed and upper surface 4 may not be constant. Also, the screen plate 30 and the surface 11 to be printed and upper surface 4 may not be parallel. Here, in the case where the whole surface of the substrate 10 is formed in a curved shape, the whole surface of the screen plate 30 is also formed in a curved shape.

The opening pattern 31 of the screen plate 30, as illustrated in FIG. 6, is constituted of multiple openings formed over the first plane 30*a*, curved part 30*b* and second plane part 30*c*. The forming position, shape and the like of the opening pattern are not limited particularly and are arbitrary.

The screen plate 30 is fixed to the inner surface of the frame body 40 through the fixing member 50. More specifically, the fixing member 50 is connected to the peripheral edge of the screen plate 30 by an adhesive or the like. The fixing member 50, similarly to the screen plate 30, is arranged through the substantially constant clearance S with respect to the surface 11 to be printed and upper surface 4, and is arranged in parallel to the surface 11 to be printed and upper surface 4. And, the peripheral edge of the fixing member 50 is fixed to the inner surface of the frame body 40 by an adhesive or the like. More specifically, the Y-direction left end of the peripheral edge of the fixing member 50 is fixed to the Z-direction lower end of the inner surface of the first side wall 42*a*. The Y-direction right end of the fixing member 50 is fixed to the Y-direction right end of the lower surface of the fourth upper frame piece 41*d* The both X-direction ends of the fixing member 50 are respectively fixed to the Z-direction lower end of the inner surfaces of the second and third side walls 42*b* and 42*c*. Here, the clearance S between the fixing member 50 and the surface 11 to be printed and upper surface 4 may not be constant. Also, the fixing member 50 and the surface 11 to be printed and upper surface 4 may not be parallel to each other.

Here, the screen plate 30 is preferably formed of a metal material. The reason for this is that a high elongation strength is necessary in order to maintain the curved shape of the screen plate 30 only by the tension of the screen plate 30. As the metal material, stainless steel and the like can be used. Furthermore, the screen plate 30 is preferably formed of a metal material having a coating film formed thereon. The reason for this is that it can achieve a higher elongation strength than the screen plate 30 formed only of a metal material. Examples of the coating film include a metal coating film, such as nickel, having a corrosion resistance and liquid repellency, a fluororesin coating film and the like, and the metal coating film having a corrosion resistance and liquid repellency is preferred.

Also, in order to absorb errors in the working and forming precision of the frame body 40, substrate 10 and mounting table 3 each including a curved part, it is necessary to increase the clearance S to a certain extent. In this case, during printing, the screen plate 30 must be greatly deformed from its original shape. Therefore, the fixing member 50 for fixing the screen plate 30 to the frame body 40 is preferably formed of a resin material easy to stretch. As the resin material, TETORON (registered trademark), nylon, polyester, rubber, and the like can be used.

(Scraper and Squeegee)

The printing device 100, as illustrated in FIG. 1, includes a scraper 6 above the screen plate 30 in the Z direction. Also, the printing device 100, as illustrated in FIG. 7, includes a squeegee 8 which moves in the opposite direction to the moving direction of the scraper 6 and, while pressing the screen plate 30 in, performs printing. The scraper 6 and squeegee 8 are pressed against the screen plate 30 at contact angles α and β where the proceeding-direction forward parts thereof on the screen plate 30 have an acute angle, while they are driven individually.

The scraper 6 spreads printing material onto the upper surface of the screen plate 30 and fills the printing material into the opening pattern 31.

The squeegee 8 rotates and displaces while pressing the upper surface of the screen plate 30 to thereby push out the printing material filled into the opening pattern 31 and transfer the pattern thereof to the surface 11 to be printed of the substrate 10.

In a state where the printing plate 20 (screen plate 30, fixing member 50 and frame body 40), substrate 10 and mounting table 3 are not displaced but are fixed, the printing device 100 rotates and displaces the scraper 6 to thereby perform a spreading process of printing material. Also, similarly, it rotates and displaces the squeegee 8 to thereby perform a push-out process of the printing material. When the spreading process is performed before the push-out process, the printing material is formed uniformly on the surface 11 to be printed of the substrate 10.

The scraper 6 and squeegee 8, although not illustrated, are connected to a scraper drive mechanism and a squeegee drive mechanism, respectively, having a similar configuration. That is, the respective drive mechanisms include rotation mechanisms for rotationally driving shaft bodies respectively supporting the scraper 6 and squeegee 8, and moving mechanisms for moving the shaft bodies within the YZ surface. The rotation mechanism and moving mechanism may be appropriate mechanisms, for example, mechanisms configured to rotate and move the scraper 6 and squeegee 8 by driving a motor.

(Printing Procedure)

The above-described printing device 100 prints the printing material on the surface 11 to be printed of the substrate 10 in the following procedure.

First, in a state where one end of the printing plate 20 is sandwiched by the clamp 44, the printing plate 20 is retracted from the mounting table 3 by being rotated counterclockwise about the connecting point P from the state illustrated in FIG. 1.

Next, the substrate 10 is mounted on the mounting table 3 while it is fitted into the groove 5. And, the vacuum holes 7 are sucked by a vacuum pump, which is not illustrated, thereby vacuum sucking the substrate 10 within the groove 5.

After setting the substrate 10 on the mounting table 3 in the above-mentioned manner, the retracted printing plate 20 is rotated clockwise about the connecting point P until the lower surface of the fourth upper frame piece 41*d* comes into contact with the upper surface of the height adjusting support rod 46. Accordingly, the clearance S is formed between the surface 11 to be printed of the substrate 10 and the screen plate 30.

Then, the scraper 6 is moved from the second plane part 30*c* of the screen plate 30 on the right side in FIG. 1 through the curved part 30*b* to the vicinity of the connecting portion on the left end of the first plane part 30*a* and the fixing member 50. In this case, the printing material is previously supplied to the upstream side in the moving direction of the scraper 6, and is spread over the whole of the screen plate 30 by the scraper 6.

In the spreading process for spreading the printing material, the scraper 6 is rotated and displaced so that the contact angle α of the scraper 6 with the upper surface of the screen plate 30 is made constant. Accordingly, the printing material is spread on the surface 11 to be printed uniformly, whereby a uniform printing can be performed. Also, the scraper 6 is rotated and displaced so that the pressing force of the scraper 6 with respect to the upper surface of the screen plate 30 is made constant. This also can spread the printing material uniformly, thereby enabling uniform printing.

Next, as illustrated in FIG. 7, the squeegee 8 is moved from the first plane part 30*a* of the screen plate 30 on the left side through the curved part 30*b* to the vicinity of the connecting portion of the left end of the second plane part 30*c* and the fixing member 50.

In the push-out process for pushing out the printing material through the opening pattern 31 to the surface 11 to be printed, the squeegee 8 is rotated and displaced so that the contact angle β formed by the surface 11 to be printed and the tip of the squeegee 8 is made constant. Accordingly, the printing material is pushed out uniformly from the screen plate 30 and therefore, the surface 11 to be printed can be printed uniformly. Also, the squeegee 8 is rotated and displaced so that the pressing force of the squeegee 8 with respect to the upper surface of the screen plate 30 is made constant. Accordingly, the printing material can be spread uniformly, thereby enabling uniform printing.

Here, although not illustrated in FIG. 7, actually, in the screen plate 30 pressed by the squeegee 8, the screen plate 30 moves relative to the frame body 40 and displaces downward in the Z direction. And, the printing material is transferred to the surface 11 to be printed of the substrate 10 through the opening pattern 31 of the screen plate 30 illustrated in FIG. 6. Accordingly, a printing layer having a desired pattern is formed on the surface 11 to be printed of the substrate 10.

A method for moving the scraper 6 relative to the printing plate 20, substrate 10 and mounting table 3 in the spreading process is not limitative. Regardless of which method is employed, the methods are the same in that the contact angle α of the scraper 6 with the upper surface of the screen plate 30 is made constant and the pressing force of the scraper 6 against the upper surface of the screen plate 30 is made constant. Here, from the viewpoint of structure, it is difficult to keep the contact angle α completely constant, allowing some change. The change is preferably controlled so as to be ±30% with reference to a desired contact angle α.

Also, in the push-out process, similarly, a method for moving the squeegee 8 relative to the printing plate 20, substrate 10 and mounting table 3 is not limitative. Regardless of which method is employed, the methods are the same in that the contact angle β of the squeegee 8 with the upper surface of the screen plate 30 is made constant and the pressing force of the squeegee 8 against the upper surface of the screen plate 30 is made constant. Here, from the viewpoint of structure, it is difficult to keep the contact angle β and pressing force completely constant, allowing some change. The change is preferably controlled so as to be ±30% with reference to a desired contact angle β and pressing force.

In the screen plate 30 of this configuration, by appropriately setting the material, area and the like of the fixing member 50 and screen plate 30, the elongation strength of the fixing member 50 is set smaller than the elongation strength of the screen plate 30. More specifically, the elongation strength of the fixing member 50 is preferably ⅘ times or less the elongation strength of the screen plate 30, more preferably ⅗ times or less, and further more preferably ⅕ times or less. Accordingly, the screen plate 30 is fixed so as to be movable relative to the frame body 40. Here, the elongation strength of the fixing member 50 formed of a resin material such as nylon and polyester is approximately 400 to 800 N/mm$^2$, and the elongation strength of the screen plate 30 formed of a metal material such as stainless steel is approximately 1,000 to 4,000 N/mm$^2$.

In the case where the screen plate 30 made of a metal material is directly fixed to the frame body 40 not through the fixing member 50 made of a resin material, since the screen plate 30 made of a metal material is high in rigidity, the amount of the screen plate 30 to be pushed in by the squeegee is very small (e.g., approximately 0.1 mm). In this case, printing can be enforced according to a so called zero gap method in which the clearance S between the screen plane 30 and surface 11 to be printed is set extremely small. In the printing of the zero gap method, it is very important to make constant the clearance S between the screen plate 30 and surface 11 to be printed. However, since the surface 11 to be printed of this embodiment includes the curved part 11*b*, it is difficult to set constant the clearance S which is a very small value.

In view of this, like the printing plate 20 of this configuration, the screen plate 30 is fixed to the frame body 40 through the fixing member 50, whereby the screen plate 30 is supported so as to be movable relative to the frame body 40. This imparts the stretchability of the fixing member 50 to the high-rigidity screen plate 30, so that the clearance S between the screen plate 30 and surface 11 to be printed can be increased comparatively. Consequently, a shape error between the screen plate 30 and surface 11 to be printed can be relieved. Furthermore, since the rigidity of the screen plate 30 remains high, the shape of the curved part 30*b* can be maintained only the tension of the screen plate 30. That is, since the printing plate 20 of this configuration combines the feature of a metal screen plate which is high in rigidity and the good feature of a resin screen plate which is tolerant of shape change, high-precision printing can be performed even on the surface 11 to be printed having a complicated shape.

In the printing plate 20 of this configuration, the clearance S between the screen plate 30 and surface 11 to be printed is preferably 1 mm or more, and more preferably 2 mm or more. In the case where the clearance S is 1 mm or more, plate removal is good. Also, the clearance S is preferably 15 mm or less, and more preferably 10 mm or less. In the case where the clearance S is 15 mm or less, since the screen plate 30 can be pushed in by the squeegee 8, printing is easy and plate removal is also good.

Also, the printing device 100 of this configuration is suitable for the case of performing a printing on such a substrate 10 as is difficult to mold after printed, and particularly suitable for the case of using a glass plate as the substrate 10. In the case where a thermoplastic resin such as acryl is used as the substrate 10, the curved part and the like can be molded after printing on a flat plate-shaped resin. The reason for this is that the molding temperature is comparatively low and thus a printed layer obtained by printing is hard to be damaged. Meanwhile, in the case of using a substrate 10 of a material such as glass whose molding temperature becomes high, when a curved part and the like are molded after performing printing on a flat glass plate, the resultant printed layer is subjected to the high temperature, thereby damaging the printed layer. In view of the above, application of the printing device 100 of this configuration is particularly beneficial to the substrate 10 which must be printed after molding the curved part and the like.

The printing device 100 of this configuration is particularly excellent in that it can perform printing on the substrate 10 including at least one curved part 11*b* on the surface 11 to be printed and having a curving depth of 10 mm or more. In the case where printing is performed on such substrate 10 by using a conventional flat plate-shaped screen plate, the substrate 10 and flat plate-shaped screen plate buffer against each other, whereby a printed layer having a uniform thickness and an excellent appearance cannot be formed. According to this configuration, even in the case of a substrate 10 having a deep curving depth, a homogenous printed layer can be formed.

The printing device 100 of this configuration is also particularly excellent in that it can perform printing on the substrate 10 including at least one concave-shaped curved part 11*b* in the surface 11 to be printed and having a curving depth of 10 mm or more. In the case where printing is performed by using a conventional flat plate-shaped screen plate, it is difficult to print uniformly the concave-curved part having a curving depth of 10 mm or more. However, according to this configuration, even in the case of the substrate 10 having a deep curving depth, a homogenous printed layer can be formed.

The thickness deviation of the resultant printed layer can be made ±10% of the average thickness of the printed layer. The thickness deviation of the printed layer is preferably ±7%, and more preferably ±5%. Since the printing plate 20 can be held in a substantially constant clearance S with respect to the substrate 10, a uniform printed layer can be formed even on the substrate having a deep curving depth.

Second Configuration Example

Next, the printing device of a second configuration example is described.

A printing device 200 of this configuration has a function to perform a spreading process and a push-out process by rotating and displacing the printing plate 20, substrate 10 and mounting table 3 in a state where the scraper 6 and squeegee 8 are not displaced but are fixed. The remaining configurations are the same as in the printing device 100 illustrated in FIG. 1 and FIG. 7.

(Moving Mechanism)

As a mechanism which rotates and displaces the printing plate 20, substrate 10 and mounting table 3 in a state where the scraper 6 and squeegee 8 are not displaced but are fixed, the printing device 200 includes, for example, such a moving mechanism 60 as illustrated in FIG. 8.

The moving mechanism 60, in the above-mentioned spreading process and push-out process, drives the printing plate 20, substrate 10 and mounting table 3.

The moving mechanism 60 includes a base table 61 for defining a vertical plane (YZ plane) and a pair of linear guide rails 62 horizontally fixed on the base table 61. On the linear guide rails 62, there is arranged a horizontal moving table 63 in a manner to be movable in the horizontal direction (Y direction). The horizontal moving table 63 can be moved in the horizontal direction by a ball screw mechanism 65 or the like which can be driven by a horizontal drive motor 64 fixed to the base table 61.

On the horizontal moving table 63, there is arranged a vertical moving table 68 which can be driven by a vertical drive motor 66 and, while being guided by a pair of linear guide rails 67, can be moved in the vertical direction (Z direction). On the vertical moving table 68, there is arranged a swinging table 70 which, when driven by a swinging drive motor 69, can be rotated in the θ direction about an axis orthogonal to the horizontal direction and vertical direction. The swinging table 70 is formed in a substantially L-like shape and includes a projecting part 71 which projects from the top part of the swinging table 70 toward the front side of the drawing and to which is fixed the mounting table 3 (see FIG. 1) capable of mounting the substrate 10 thereon.

Here, the horizontal moving table 63, vertical moving table 68 and swinging table 70 may also be constituted of another horizontal moving mechanism, another vertical moving mechanism and another swinging drive mechanism so long as they are mechanisms capable of moving in the horizontal direction, moving in the vertical direction and rotating, respectively, and are not limited to the movement and rotation caused by a combination of the motor and ball screw mechanism.

(a), (b) and (c) of FIG. 9 are process explanatory views illustrating a state where the mounting table, substrate and printing plate are rotated and displaced in the push-out process that is performed by the printing device 200 of this configuration.

According to the printing device 200 of this configuration, in a state where the substrate 10 is supported on the mounting table 3, the mounting table 3 is driven by the moving mechanism 60 illustrated in FIG. 8. The squeegee 8 is moved on the screen plate 30 by moving the mounting table 3 from an initial state illustrated in (a) of FIG. 9 leftward in the drawing as illustrated in (b) of FIG. 9. And, as illustrated in (c) of FIG. 9, the mounting table 3 is inclined by the moving mechanism 60, whereby the squeegee 8 is moved from the curved part 30*b* of the screen plate 30 to the second plane part 30*c*.

As described above, the printing device 200 of this configuration is configured such that the mounting table 3 is moved and rotated with respect to the fixed squeegee 8 by the moving mechanism 60. Thus, as compared to a configuration that the squeegee 8 is moved and rotated, vibrations or the like are hard to be generated when the printing material is pushed out by the squeegee 8. Also, the thickness of a printed layer can be made uniform, whereby printing quality can be enhanced.

Besides the above-mentioned configuration, the spreading process and push-out process may also be performed by rotating and displacing the scraper 6 and squeegee 8 and further rotating and displacing the printing plate 20, substrate 10 and mounting table 3. In this case, the method for moving the scraper 6 and squeegee 8 relative to the printing plate 20, substrate 10 and mounting table 3 in the spreading process and push-out process is not limitative. Regardless of which method is employed, the methods are the same in that the contact angle α between the surface 11 to be printed and scraper 6 and the contact angle β between the surface to be printed and squeegee 8 are made constant respectively and the pressing forces of the scraper 6 and squeegee 8 with respect to the upper surface of the screen plate 30 are made constant.

Third Configuration Example

Next, the printing device of a third configuration example is described.

FIG. 10 is a cross-sectional view of main parts of a printing device 300 of the third configuration example, illustrating a state where a squeegee is rotated and displaced for printing. Here, in the following description, the same members and parts as illustrated in FIG. 1 and FIG. 7 are given the same signs and thus, the descriptions thereof are omitted or simplified.

The printing device 300 of this configuration performs printing on a twisted substrate 10A in which the shape of the curved part 10*b* changes along the X direction. Here, the term "twist" used herein means that the radius of curvature of the curved part need not be constant and the open angle thereof also need not be constant, and refers to a shape obtained thereby. Specifically, when the substrate 10A of FIG. 11 is observed along cross-sectional planes orthogonal to the X axis, that is a surface parallel to the YZ surface, they have different radii of curvature and open angles.

FIG. 11 is a perspective view schematically illustrating the appearance of the twisted substrate 10A.

The surface 11 to be printed of the twisted substrate 10A includes a first plane part 11*a* parallel to the XY surface, a curved part 11*b* connected to the first plane part 11*a* and a second plane part 11*c* connected to the curved part 11*b*, so as to respectively correspond to the first plane part 10*a*, curved part 10*b* and second plane part 10*c*.

The curved part 11*b* has a curved shape in which the surface 11 to be printed has a radius of curvature R1 in the front side of FIG. 11, which is one end in the X direction, and has a curved shape in which the surface 11 to be printed has a radius of curvature R2 smaller than the radius of curvature R1 in the back side of FIG. 11, which is the other end in the X direction. The curved part 11*b* has a shape whose radius of curvature changes continuously from R1 to R2 along the X direction, for example, a shape obtained when a flat plate material is bent with being twisted.

FIG. 12 is a perspective view of a printing plate for preforming a printing on such twisted substrate 10 as illustrated in FIG. 11.

In this case, a printing plate 20A includes a screen plate 30A having an opening pattern 31 and a frame body 40A to which the screen plate 30A is fixed through a fixing member 50A.

In the screen plate 30A, the opening pattern 31 is constituted of multiple openings formed over a first plane part 30*a*, a curved part 30*b* and a second plane part 30*e*. The curved part 30*b* of the screen plate 30A is configured such that a radius of curvature along the X direction changes continuously from R1 to R2.

FIG. 13 is a cross-sectional view taken along the XIII-XIII line of FIG. 12, and FIG. 14 is a cross-sectional view taken along the XIV-XIV line of FIG. 12. In the curved part 30*b* of the screen plate 30A, the radii of curvature thereof are different along the X direction in such a manner that the radii of curvature of X-direction one end and the other end illustrated in FIG. 13 and FIG. 14 provide R1 and R2, respectively. Here, in the illustrated example, since the thickness of the screen plate 30A is exaggerated, the radius of curvature of the lower surface (the surface facing the printing plate) of the screen plate 30A is illustrated. However, the actual thickness is very thin and the front and back surfaces of the screen plate 30A have substantially the same radius of curvature.

FIG. 15 is a top view of the screen plate 30A illustrated in FIG. 12.

Here, virtual lines L1, L2 and L3 illustrated in FIG. 12 and FIG. 15 can be considered to be straight lines which, when the X-direction both ends of the surface to be printed of the curved part 10*b* of the substrate 10A are viewed in side view in the X direction respectively, are obtained by connecting together the ends whose normal directions orthogonal to the tangent of the surface to be printed coincide with each other. Therefore, on one virtual line, there is provided a surface to be printed, which faces in the same direction and whose normal directions are all coincide with each other. That is, the virtual lines L1, L2 and L3 are contact lines along which, when the squeegee 8 is rotated and moved straight ahead, the tip of the squeegee 8 touches through the screen plate 30A. The virtual line L1 shows the boundary between the first plane part 30*a* and curved part 30*b*, and the virtual line L3 shows the boundary between the curved part 30*b* and second plane part 30*c*. The virtual line L2 is an intermediate line between the virtual lines L1 and L2 and, on the virtual line L2, the normal directions are the same direction.

When the printing plate 20A is used and the squeegee 8 is moved while it is pressed against the screen plate 30A, in the area of the first plane part 30*a* of the screen plate 30A, the longitudinal direction of the squeegee 8 is made parallel to the X direction And, when the squeegee 8 reaches the curved part 30*b*, the squeegee 8 is inclined gradually from the state parallel to the virtual line L1 so as to be parallel to the virtual line L2. And, when the squeegee 8 reaches the virtual line L2, the longitudinal direction thereof is made to coincide with the virtual line L2. Furthermore, when the movement of the squeegee 8 is advanced to reach the virtual line L3, the longitudinal direction of the squeegee 8 is made to coincide with the virtual line L3.

That is, as the squeegee 8 moves, the squeegee 8 is rotated continuously within the XY surface illustrated in FIG. 15, so that the surface (the surface 11 to be printed illustrated in FIG. 10) of the substrate 10A against which the squeegee 8 is pressed through the screen plate 30A is made to face in the same normal direction all the time. Due to this, the squeegee 8 is always pressed in the same direction against the surface 11 to be printed of the substrate 10A with a shape having a twist component. Consequently, the contact angle formed between the surface 11 to be printed and the tip of the squeegee 8 is made constant and the printing material is pushed out uniformly to the surface 11 to be printed, thereby enabling good printing. Thus, there can be obtained a printed state which is homogenous and excellent in aesthetic appearance.

The squeegee 8, as described above, is connected to a squeegee drive mechanism, which is not illustrated, composed of a motor or the like and, when driven by the squeegee drive mechanism, is changed to be a desired angle and a desired position with the movement in the Y direction illustrated in FIG. 10.

The inclination angle of the squeegee 8 from the X direction is not limited to the mode of continuously changing with the movement of the squeegee 8 in the Y direction from the virtual line L1 to L3. The squeegee 8 may be moved in the Y direction in a state parallel to the virtual line L3 from the beginning, or may be approached to the virtual lines L2 and L3 from a state parallel to the virtual line L1 before reaching the virtual line L1.

For more reliable functions of rotation and movement of the squeegee 8, a guide member 81 illustrated in FIG. 10 may be provided in the printing plate 20A of this configuration.

The guide member 81 is formed on the second side wall 42*b* and third side wall 42*c* of the frame body of the printing plate 20A. The guide member 81 includes on the upper surface thereof a guide surface 83 which makes rolling contact with cam followers 85 provided on the both ends of the squeegee 8 in the rotation axis direction which is the longitudinal direction (X direction). The guide surface 83 is formed along the moving passage of the squeegee 8 within the YZ plane, and the cam followers 85 roll along the guide surface 83 to guide the squeegee 8.

In the case where at least one of the cam followers 85 and guide surface 83 includes soft material such as rubber in their mutual rolling contact surface, smooth moving operation with less vibration can be achieved. Here, the cam follower 85 may also be composed of a roller or a pin.

According to this configuration, the rotation mechanism and moving mechanism of the squeegee 8 as well as the rolling movement between the guide surface 83 of the guide member 81 and cam followers 85, can enhance the maintainability of the angle of the squeegee 8 and the maintainability of the pressing force against the screen plate 30A.

A cross-sectional view of main parts of the printing device 300 of this configuration is illustrated in FIG. 16.

The screen plate 30A is supported on a frame body 40A through a fixing member 50A. In the design of the screen plate 30A, the radius of curvature r2 of a curved part 30*b* is preferably smaller than the radius of curvature r1 of the curved part 11*b* of the surface to be printed of the substrate 10A. The center $O_1$ of the radius of curvature of the curved part 11*b* of the substrate 10A and the center $O_2$ of the radius of curvature of the curved part 30*b* of the screen plate 30A need not necessarily coincide with each other. Also, a clearance between the screen plate 30A and substrate 10A in the overlapping direction preferably narrows gradually toward the printing direction from a clearance in the printing start part. That is, where the distance at the printing start point is denoted as $d_1$ and the distance in the vicinity of the curved part is denoted as $d_2$, $d_1>d_2$.

According to the above-mentioned configuration, plate removal is good and thus the enhanced quality and enhanced precision of printing can be expected.

Fourth Configuration Example

Next, the printing device of a fourth configuration example is described.

FIG. 17 is a cross-sectional view of main parts of a printing device 400 of the fourth configuration example, illustrating a state where a squeegee is rotated and displaced for printing.

The printing device 400 of this configuration is the same in configuration to the printing device 300 of the third configuration example except that a pressing member 87 facing the guide surface 83 of the guide member 81 is provided to the printing device 300.

The pressing member 87 includes a guide surface 89 parallel to the guide surface 83 of the guide member 81, and a clearance between the guide surface 83 and guide surface 89 is set to a width W substantially the same as the outside diameter of the cam follower 85.

The cam followers 85 of the squeegee 8 are inserted between the guide surface 83 of the guide member 81 and the guide surface 89 of the pressing member 87. And, the squeegee 8 moves while it is rolling the cam followers 85 between the guide surfaces 83 and 89.

According to the printing device 400 of this configuration, the cam followers 85 are sandwiched between the guide surfaces 83 and 89 and thus the shaking thereof with the movement of the squeegee 8 is reduced, whereby printing quality is enhanced.

Also, instead of providing the pressing member 87, in the second side wall 42*b* and third side wall 42*c*, there may be formed grooves on which the cam followers 85 (or, rollers or pins) existing on the longitudinal-direction both ends of the squeegee 8 roll and move.

Here, while the printing device 300 of the third configuration example and the printing device 400 of the fourth configuration example both illustrate the configuration of the squeegee 8, a similar configuration can also be applied to the scraper 6 and a similar operation effect can be obtained. Also, there may also be employed a configuration in which moving passages are separately formed for the squeegee 8 and for the scraper 6.

Here, in this configuration as well, a clearance between the screen plate 30A and substrate 10A in the overlapping direction preferably narrows gradually from a clearance in the printing start part toward the printing direction.

Fifth Configuration Example

Next, the printing device according to a fifth configuration example.

FIG. 18 is a cross-sectional view of main parts of a printing device 500 of the fill configuration example, illustrating a configuration example of another mounting table.

The printing device 500 of this configuration employs a retraction mechanism in the mounting table 3A instead of providing the recess 9 (see, e.g., FIG. 1) in the mounting table 3 in the above-described respective configuration examples.

In the mounting table 3A, portions for supporting the ends of the substrate 10 are formed to be separated from a mounting table main body 3*a* and are formed as retraction blocks 3*b* and 3*c* which can be lifted and lowered with respect to the mounting table main body 3*a*.

The retraction block 3*b* supports an end of the substrate 10 facing the recess 9 of the above-described mounting table 3 and can be lowered by a lifting motor or the like, which is not illustrated, with respect to the mounting table main body 3*a* supporting the central part of the substrate 10. Similarly, the retraction block 3*c* also supports the end of the substrate 10 and can be lowered with respect to the mounting table main body 3*a*.

When the retraction blocks 3*b* and 3*c* lower from the mounting table main body 3*a*, the end of the substrate 10 supported by the mounting table main body 3*a* is projected from the ends 91 and 93 of the mounting table main body 3*a*. Thus, after the vacuum suction is removed, by lifting these projected portions of the substrate 10 upward, the substrate 10 can be removed simply from the mounting table main body 3*a*.

According to the printing device 500 of this configuration, the removing work of the substrate 10 can be automated and thus a sample can be collected with high efficiency.

Here, although the illustrated example illustrates the configuration in which the retraction block 3*b* is lowered from the mounting table main body 3*a*, a configuration may also be employed in which the mounting table main body 3*a* is lifted from the retraction block 3*b*. That is, any mechanism may be employed so long as the retraction blocks 3*b* and 3*c* can be lifted and lowered relative to the mounting table main body 3*a*.

The present invention is not limited to the above-described embodiments but combinations of the respective configurations of these embodiments as well as modifications or applications by a person skilled in the art based on the description of the present specification and well-known technology are also expected in the present invention and included within the scope seeking protection.

This application is based on the Japanese Patent Application No. 2015-226120 filed on Nov. 18, 2015 and the Japanese Patent Application No. 2016-155999 filed on Aug. 8, 2016, and the contents thereof are incorporated herein by reference.

REFERENCE SIGNS LIST

3, 3A Mounting table
3*a* Mounting table main body
3*b*, 3*c* Retraction block
4 Upper surface
5 Groove

6 Scraper
7 Vacuum hole
8 Squeegee
9 Recess
10, 10A Substrate
10*a* First plane part
10*b* Curved part
10*c* Second plane part
11 Surface to be printed
11*a* First plane part
11*b* Curved part
11*c* Second plane part
12 Lower surface
20 Printing plate
30, 30A Screen plate
30*a* First plane part
30*b* Curved part
30*c* Second plane part
31 Opening pattern
40, 40A Frame body
41 tipper frame
41*a* First upper frame piece (upper frame piece)
41*b* Second upper frame piece (upper frame piece)
41*c* Third upper frame piece (upper frame piece)
41*d* Fourth upper frame piece (upper frame piece)
42*a* First side wall (side wall)
42*b* Second side wall (side wall)
42*c* Third side wall (side wall)
43*a*, 43*c* Lower surface
44 Clamp
45 Support rod
46 Height adjusting support rod
50 Fixing member
60 Moving mechanism
61 Base table
62 Linear guide rail
63 Horizontal moving table
64 Horizontal drive motor
65 Ball screw mechanism
66 Vertical drive motor
67 Linear guide rail
68 Vertical moving table
69 Swinging drive motor
70 Swinging table
71 Projecting part
81 Guide member
83 Guide surface
85 Cam follower
87 Pressing member
89 Guide surface
100, 200, 300, 400 Printing device
L1, L2, L3 Virtual line
P Connecting point
S Clearance

The invention claimed is:

1. A printing plate, comprising:
a screen plate having an opening pattern;
a frame body to which the screen plate is fixed; and
a fixing member which is connected to a peripheral edge of the screen plate and whose peripheral edge is fixed to the frame body;
wherein the screen plate comprises at least one curved part and is relatively movably fixed to the frame body;
wherein the screen plate is relatively movably fixed to the frame body by setting an elongation strength of the fixing member smaller than an elongation strength of the screen plate; and
wherein the curved part of the screen plate has a radius of curvature that is in a direction perpendicular to a main surface of the curved part of the screen plate.

2. The printing plate according to claim 1, wherein the fixing member comprises a resin material.

3. The printing plate according to claim 1, wherein the screen plate comprises a metal material.

4. The printing plate according to claim 1, wherein the screen plate comprises at least one plane part.

5. The printing plate according to claim 1, wherein a whole surface of the screen plate is curved.

6. A printing device, comprising:
a mounting table on which a substrate having a surface to be printed having at least one curved part is mounted;
the printing plate according to claim 1, arranged above the mounting table; and,
a squeegee arranged above the screen plate of the printing plate and configured to push out a printing material to the surface to be printed through the opening pattern of the screen plate.

7. The printing device according to claim 6, wherein the at least one curved parts of the screen plate and of the substrate are concave curved parts.

8. The printing device according to claim 6, further comprising a squeegee drive mechanism capable of moving the squeegee relative to the screen plate, the substrate and the mounting table so that an angle formed by the surface to be printed and the squeegee is constant.

9. The printing device according to claim 8, wherein the squeegee drive mechanism includes a rotation shaft capable of rotating the squeegee.

10. The printing device according to claim 9, wherein the printing plate comprises a guide member having a guide surface supporting both ends of direction of the rotation shaft, and
the squeegee is configured to perform the relative movement while cam followers provided on the both ends of direction of the rotation shaft are in rolling contact with the guide surface.

11. The printing device according to claim 10, further comprising a pressing member provided so as to face the guide member and forming a clearance with the guide surface, guiding the cam followers.

12. The printing device according to claim 6, further comprising a squeegee drive mechanism capable of moving the squeegee relative to the screen plate, the substrate and the mounting table so that a pressing force of the squeegee with respect to the screen plate is constant.

13. The printing device according to claim 6, further comprising a scraper arranged above the screen plate of the printing plate and configured to spread the printing material onto the screen plate.

14. The printing device according to claim 6, wherein the mounting table comprises a mounting table main body supporting a central part of the substrate and a retraction block supporting the end of the substrate, and the retraction block is configured to move upward and downward relative to the mounting table main body.

15. The printing device according to claim 6, wherein the substrate is a glass plate.

16. A method for manufacturing a substrate comprising a surface to be printed having at least one curved part and a printed layer formed on the surface to be printed,
the method comprising pushing out a printing material to the surface to be printed through the opening pattern of the screen plate by the squeegee in the printing device of claim 6.

17. The method for manufacturing a substrate according to claim 16, further comprising, when pushing out the printing material to the surface to be printed, moving the squeegee relative to the screen plate and the substrate so that an angle formed by the surface to be printed and the squeegee is constant.

18. The method for manufacturing a substrate according to claim 16, further comprising, when pushing out the printing material to the surface to be printed, moving the squeegee relative to the screen plate and the substrate so that a pressing force of the squeegee to be applied to the screen plate is constant.

19. The method for manufacturing a substrate according to claim 16, wherein the printing device further comprises a scraper arranged above the screen plate of the printing plate, the method further comprising, before pushing out the printing material to the surface to be printed, spreading the printing material onto the screen plate by the scraper.

20. The method for manufacturing a substrate according to claim 19, further comprising, when spreading the printing material onto the screen plate, moving the scraper relative to the screen plate so that a contact angle of the scraper with respect to the screen plate is constant.

21. The method for manufacturing a substrate according to claim 19, further comprising, when spreading the printing material onto the screen plate, moving the scraper relative to the screen plate so that a pressing force of the scraper to be applied to the screen plate is constant.

* * * * *